US006919854B2

(12) United States Patent
Milroy et al.

(10) Patent No.: US 6,919,854 B2
(45) Date of Patent: Jul. 19, 2005

(54) VARIABLE INCLINATION CONTINUOUS TRANSVERSE STUB ARRAY

(75) Inventors: William W. Milroy, Torrance, CA (US); Stuart B. Coppedge, Manhattan Beach, CA (US); Alan C. Lemons, Redondo Beach, CA (US)

(73) Assignee: Raytheon Company, Waltham, MA (US)

( * ) Notice: Subject to any disclaimer, the term of this patent is extended or adjusted under 35 U.S.C. 154(b) by 70 days.

(21) Appl. No.: 10/444,704

(22) Filed: May 23, 2003

(65) Prior Publication Data

US 2004/0233117 A1 Nov. 25, 2004

(51) Int. Cl.[7] ..... H01Q 1/34; H01Q 1/32
(52) U.S. Cl. ..... 343/770; 343/771; 343/772
(58) Field of Search ..... 343/770, 772, 343/754, 757, 758, 759, 763, 765, 766, 831, 771, 745; H01Q 1/31, 1/32

(56) References Cited

U.S. PATENT DOCUMENTS

| | | | | |
|---|---|---|---|---|
| 3,611,396 A | * | 10/1971 | Jones, Jr. | 343/776 |
| 5,266,961 A | | 11/1993 | Milroy | 343/772 |
| 5,349,363 A | | 9/1994 | Milroy | 343/772 |
| 5,361,076 A | * | 11/1994 | Milroy | 343/772 |
| 5,483,248 A | | 1/1996 | Milroy | 343/785 |
| 5,604,505 A | * | 2/1997 | Matterer | 343/772 |
| 5,995,055 A | | 11/1999 | Milroy | 343/772 |
| 6,473,057 B2 | * | 10/2002 | Monzon | 343/909 |

* cited by examiner

*Primary Examiner*—Trinh Vo Dinh
(74) *Attorney, Agent, or Firm*—Leonard A. Alkov; Karl A. Vick

(57) ABSTRACT

An antenna array employing continuous transverse stubs as radiating elements is disclosed. In an exemplary embodiment, the array includes an upper conductive plate structure comprising a set of continuous transverse stubs, and a lower conductive plate structure disposed in a spaced relationship relative to the upper plate structure. A rotation apparatus provides rotation between the upper plate structure and the lower plate structure.

55 Claims, 22 Drawing Sheets

FIG. 2A
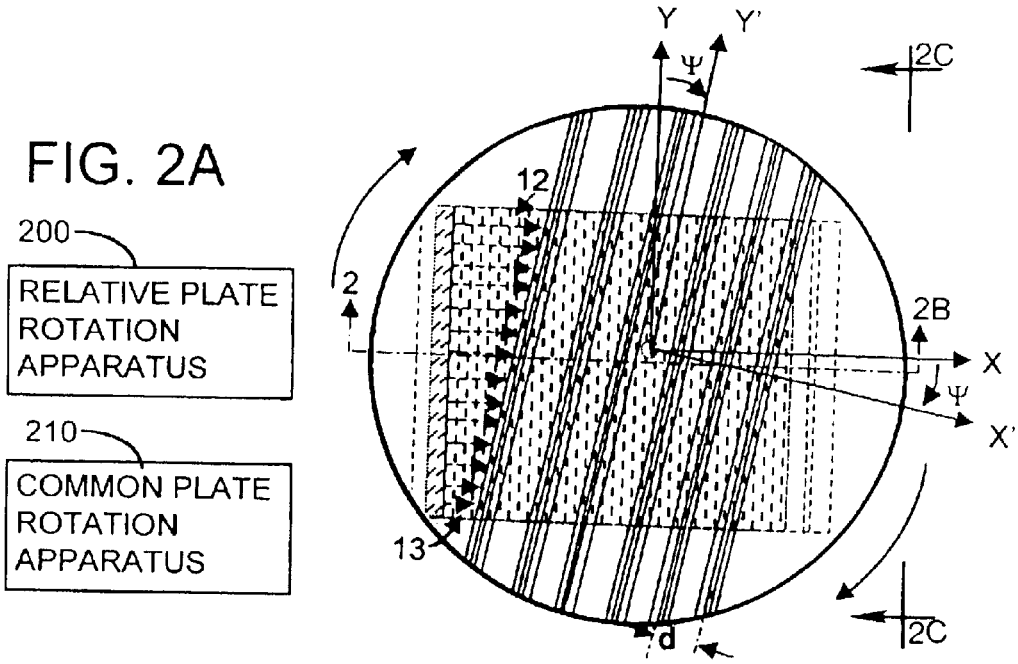
FIG. 2B
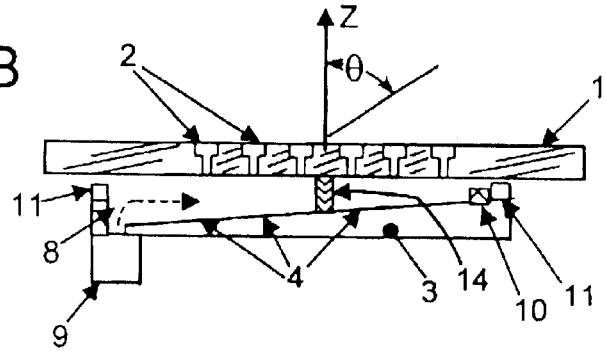
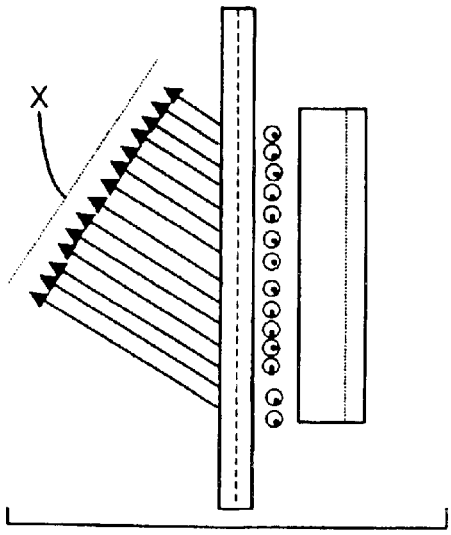
FIG. 2C

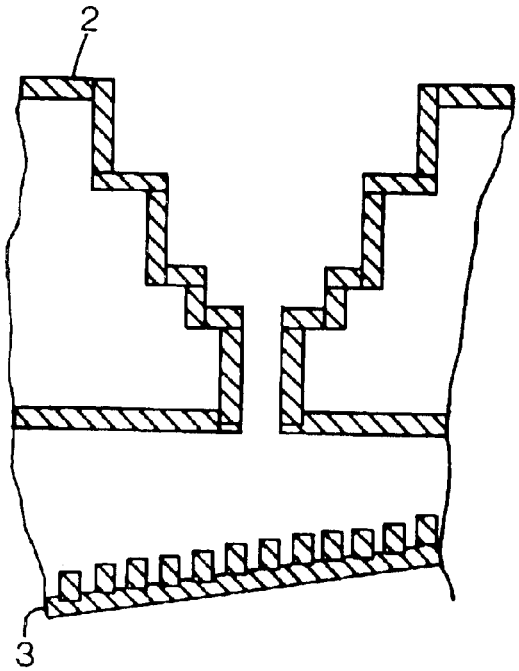
FIG. 7A
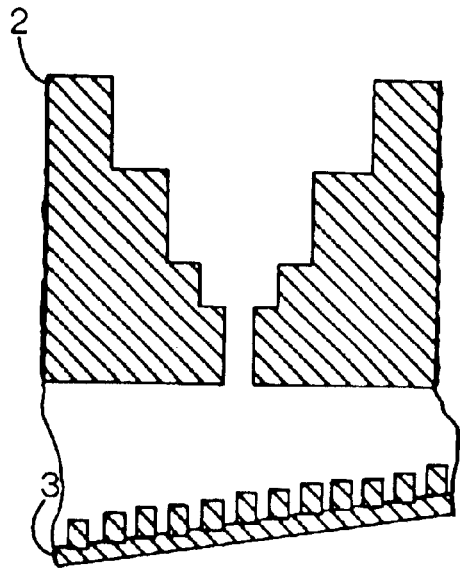
FIG. 7B
FIG. 8
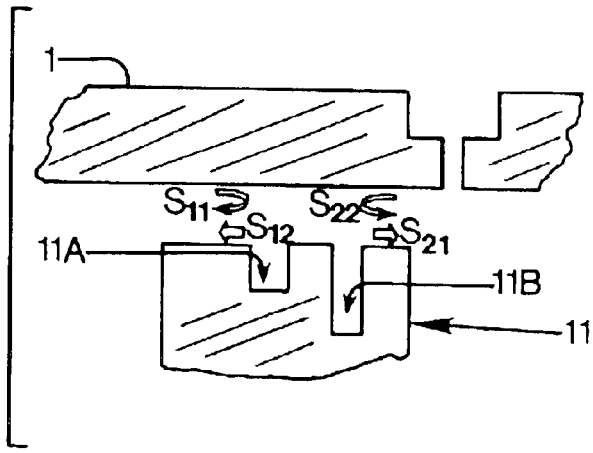

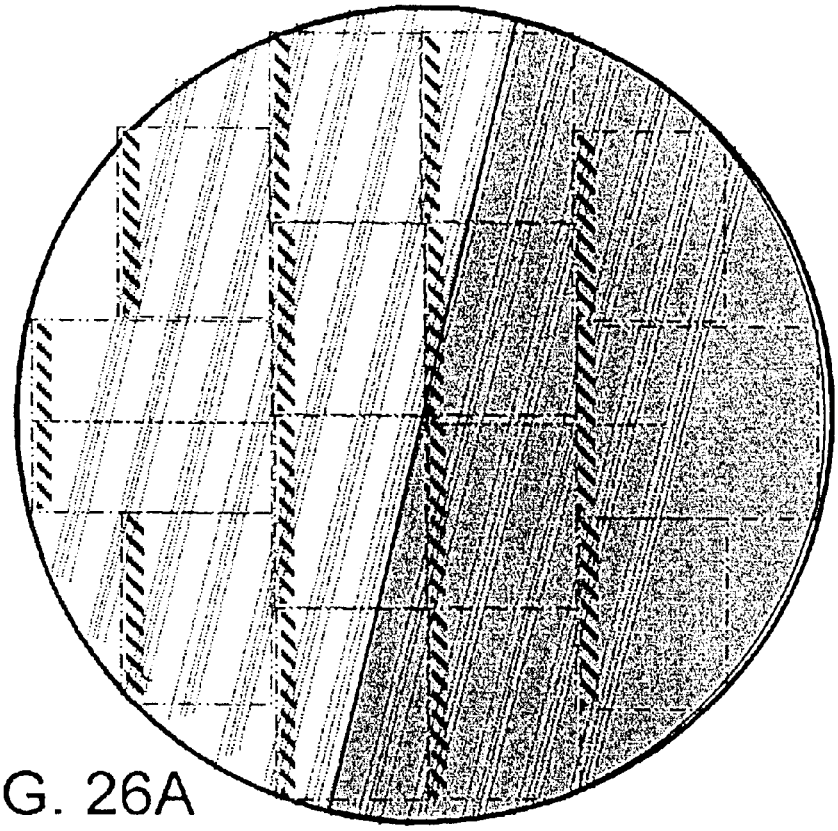
FIG. 26A
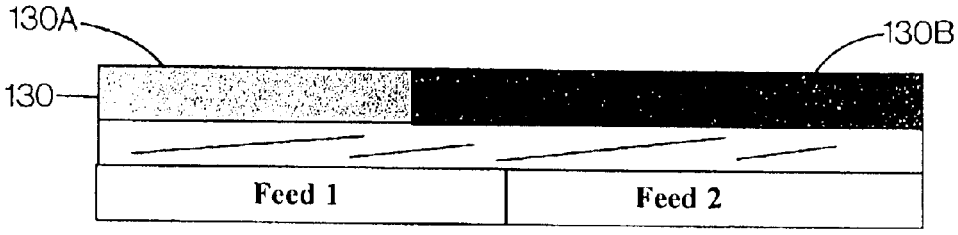
FIG. 26B
FIG. 27
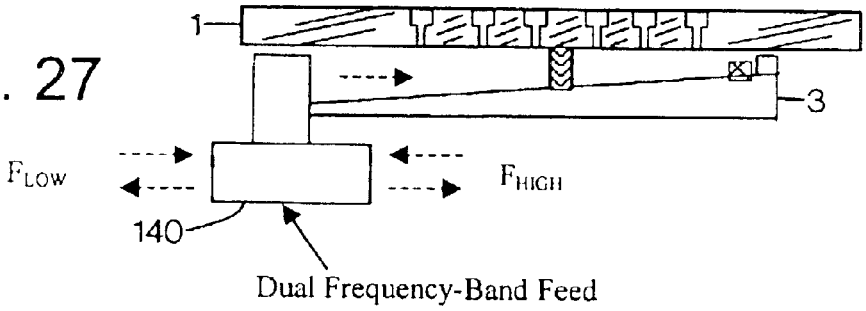

VARIABLE INCLINATION CONTINUOUS TRANSVERSE STUB ARRAY

BACKGROUND OF THE DISCLOSURE

Many antenna applications require directive (high-gain, narrow beamwidth) beams which can be selectively steered over a pseudo-hemispherical scan volume while maintaining a conformal (thin) mechanical profile. Such low-profile two-dimensionally scanned antennas are generically referred to as phased arrays in that the angle between the electromagnetic phase-front and the mechanical normal of the array can be selectively varied in two-dimensions. Conventional phased arrays include a fully-populated lattice of discrete phase-shifters or transmit-receive elements each requiring their own phase- and/or power-control lines. The recurring (component, assembly, and test) costs, prime power, and cooling requirements associated with such electronically controlled phased arrays can be prohibitive in many applications. In addition, such conventional arrays can suffer from degraded ohmic efficiency (peak gain), poor scan efficiency (gain roll-off with scan), limited instantaneous bandwidth (data rates), and data stream discontinuities (signal blanking between commanded scan positions). These cost and performance issues can be particularly pronounced for physically large and/or high-frequency arrays where the overall phase-shift/transmit-receive module count can exceed many tens of thousands elements.

SUMMARY OF THE DISCLOSURE

An antenna array employing continuous transverse stubs as radiating elements is disclosed. In an exemplary embodiment, the array includes an upper conductive plate structure comprising a set of continuous transverse stubs, and a lower conductive plate structure disposed in a spaced relationship relative to the upper plate structure. A rotation apparatus provides rotation between the upper plate structure and the lower plate structure. The differential and common rotation of the plates scans the antenna in two dimensions.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2A is a top view similar to FIG. 1A, but with the upper plate rotated relative to the bottom plate.

FIG. 2B is a cross-sectional view taken along line 2B—2B of FIG. 2A.

FIG. 2C illustrates the radiated electromagnetic phase front resulting from the antenna orientation of FIG. 2A.

FIGS. 7A and 7B illustrates embodiments of multiple impedance stage stubs.

FIG. 8 illustrates the non-contacting choke utilized with CTS stubs for the embodiment of FIGS. 1A–2C.

FIGS. 26A–26B illustrate an embodiment wherein one part of a VITCS array receives and transmits a right hand circularly polarized (RHCP) signal and a second part receives and transmits a left had circularly polarized (LHCP) signal.

FIG. 27 illustrates an embodiment of a dual frequency band VITCS array.

DETAILED DESCRIPTION OF THE DISCLOSURE

A Variable Inclination Continuous Transverse Stub (VICTS) array in an exemplary embodiment includes two plates, one (upper) comprising a one-dimensional lattice of continuous radiating stubs and the second (lower) comprising one or more line sources emanating into the parallel-plate region formed and bounded between the upper and lower plates. Mechanical rotation of the upper plate relative to the lower plate serves to vary the inclination of incident parallel-plate modes, launched at the line source(s), relative to the continuous transverse stubs in the upper plate, and in doing so constructively excites a radiated planar phase-front whose angle relative to the mechanical normal of the array (theta) is a simple continuous function of the relative angle ($\psi$) of (differential) mechanical rotation between the two plates. Common rotation of the two plates in unison moves the phase-front in the orthogonal azimuth (phi) direction. Exemplary embodiments of this simple innovative scan mechanism can provide some or all of the following capabilities, including: dramatically reduced component, assembly, and test costs (in one exemplary simple form, there are only three integrated passive RF components of the VICTS, a radiating CTS plate, a lower base plate and a dielectric support, with no phase-shifters, T/R modules, or associated control/power distribution); reduced prime power and cooling requirements (no phase shifters or T/R modules in an exemplary embodiment); improved instantaneous bandwidth (the primary scan mechanism of the VICTS is a "true-time-delay" optical phenomena). Further, extreme composite scan angles are achieved while maintaining moderate scan angles and well-behaved scan impedances in each of the cardinal planes); continuous datastream (the scan mechanism is completely analog and the beam scan angle is therefore continuously defined and well-behaved).

Figure 1A:
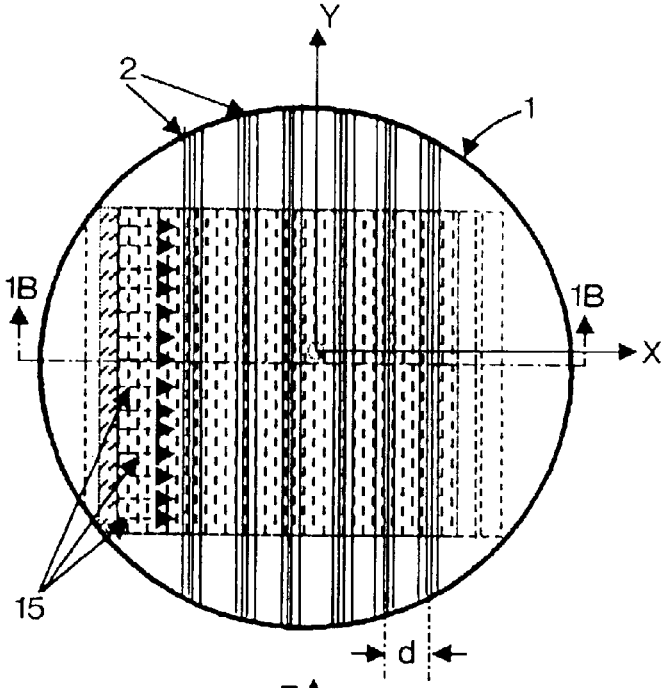
FIG. 1A is a top view of a portion of an exemplary embodiment of a VITCS in accordance with the invention.
Figure 1B:
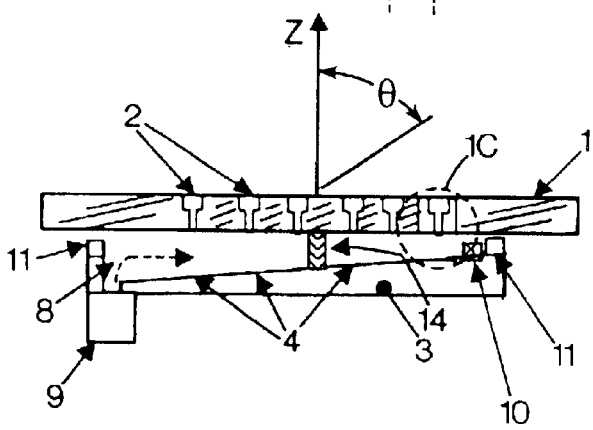
FIG. 1B is a simplified cross-sectional view taken along line 1B—1B of FIG. 1A.
Figure 1C:
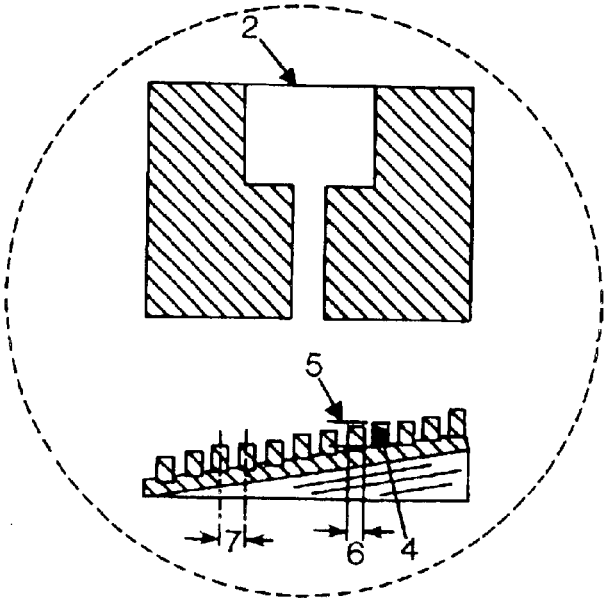
FIG. 1C is an enlargement of a portion of the embodiment illustrated in FIG. 1B.

An exemplary embodiment of a variable inclination continuous transverse stub (VICTS) array is illustrated in FIGS. 1A–1C in a rectangular X, Y, Z coordinate frame of reference. FIG. 1A is a top view of a conductive upper plate 1 and a lower conductive plate 3, shown disposed in a plane parallel to the X-Y plane. The upper plate 1 contains a set of identical, equally spaced, Continuous Transverse Stub (CTS) radiators 2. CTS radiators are well known in the art, e.g. U.S. Pat. Nos. 5,349,363 and 5,266,961. Note that a total of six (6) stubs are shown as an example, although upper plates 1 containing more stubs, or less stubs may alternatively be deployed.

FIG. 1B is a cross-sectional view taken along line 1B—1B of FIG. 1A, showing in cross-section the upper plate 1 and lower conductive plate 3. FIG. 1C is an enlarged view of a portion of FIG. 1B. The lower conductive plate 3 is made in such a way that its cross-section varies in height in the positive z-direction as a function of x-coordinate as shown. Both plates are located in X, Y, Z space in such a way that they are centered about the z-axis. An optional dielectric support 14 is disposed along the z-axis and acts as a support between the upper and lower plates.

The top surface of the lower plate 3 contains a number of rectangular shaped corrugations 4 with variable height 5, width 6, and centerline-to-centerline spacing 7. As shown in FIG. 1C in this exemplary embodiment, the corrugations 4 are disposed with constant cross-section over the full length of the lower plate 3 in the y-direction.

The lower surface of plate 1 and the upper corrugated surface of plate 3 form a quasi-parallel plate transmission line structure that possesses plate separation that varies with x-coordinate. The transmission line structure is therefore periodically loaded with multiple impedance stage CTS radiating stubs 2 that are contained in plate 1. Further, plate 1 along with the upper surface of plate 3 form a series-fed CTS radiating array, with novel features, including that the parallel plate spacing varies in one dimension and corrugations are employed to create an artificial dielectric or slow-wave structure.

Figure 1D:
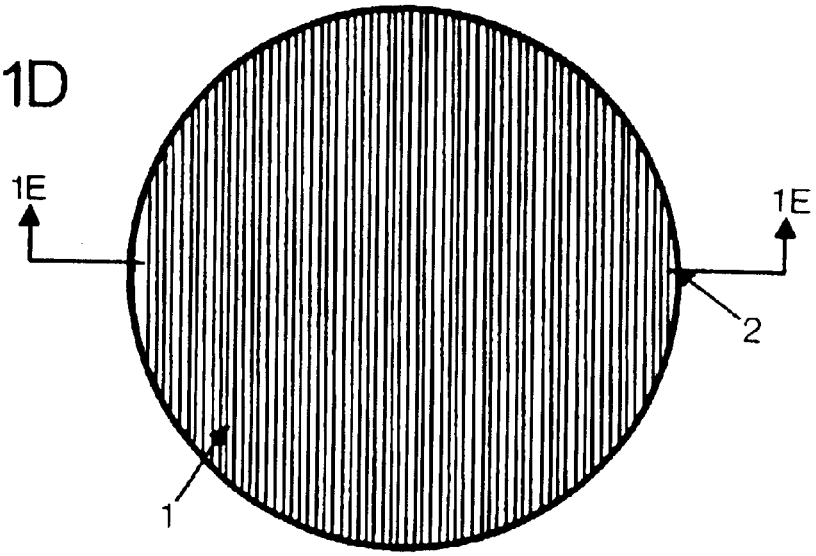
FIG. 1D is a top view of an alternate embodiment of a VITCS array employing an extrusion-based upper plate.
Figure 1E:
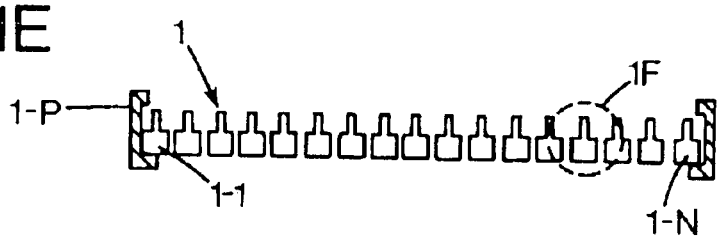
FIG. 1E is a cross-sectional view taken along line 1E—1E of FIG. 1D.
Figure 1F:
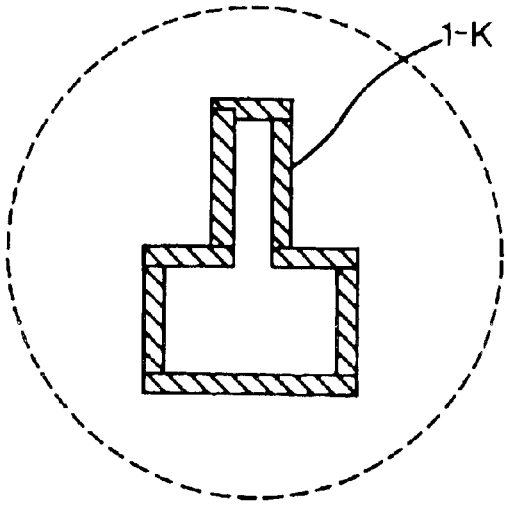
FIG. 1F is an enlargement of a portion of the embodiment illustrated in FIG. 1E.

The upper plate 1, shown in FIG. 1B as being fabricated from a solid conductive plate, can take different forms. For example, as shown in FIGS. 1D–1F, the upper plate can be fabricated as a set of closely spaced extrusions 1-1 to 1-N, with typical extrusion 1-K shown in the enlarged cross-sectional view of FIG. 1F, held together by a conductive frame 1-P.

The CTS array may be excited from below at one end 8 by a generic linear source 9. Traveling-waves consisting of parallel-plate modes are created by the source between the lower surface of the upper plate and the upper surface of the lower plate. These modes propagate in the positive x-direction. Plane wave-fronts associated with these modes are contained in planes parallel to the Y-Z plane. Dotted arrows, 15, indicate the direction of rays associated with these modes in a direction perpendicular to the Y-Z plane.

As the traveling-waves propagate in the positive x-direction away from the linear source 9, corresponding longitudinal surface currents flow on the lower surface of the upper plate and the upper surface of the lower plate and corrugations in the positive x-direction. The currents flowing in the upper plate are periodically interrupted by the presence of the stub elements. As such, separate traveling waves are coupled into each stub that travel in the positive z-direction to the top surface of the upper plate and radiate into free space at the terminus of the uppermost impedance stage.

The collective energy radiated from all the stub elements causes an antenna pattern to be formed far away from the upper surface of the upper plate. The antenna pattern will show regions of constructive and destructive interference or sidelobes and a main beam of the collective waves and is dependent upon the frequency of excitation of the waves and geometry the CTS array. The radiated signal will possess linear polarization with a very high level of purity. The stub centerline to centerline spacing, d, and corrugation dimensions 5, 6, and 7 (FIG. 1C), may be selected such that the main beam is shifted slightly with respect to the mechanical boresight of the antenna defined by the z-axis.

Any energy not radiated into free space will dissipate in an rf energy-absorbing load 10 placed after the final stub in the positive x-direction. Unique non-contacting frictionless rf chokes, 11, placed before the generic linear source (negative x-direction) and after the rf energy-absorbing load (positive x-direction) prevent unwanted spurious radiation of rf energy.

If the upper plate 1 is rotated or inclined in a plane parallel to the X-Y plane as shown in FIG. 2A by some angle $\psi$, the effect of such a rotation is that the orientation of the stubs relative to the fixed incident waves emanating from the source is modified. As the waves travel away from the source towards the stubs, rays incident upon the stubs towards the top 12, (positive y-coordinate) of the parallel plate region arrive later in time than rays incident towards the bottom 13 of the parallel plate region (negative y-coordinate). Consequently, waves coupled from the parallel plate region to the stubs will possess a linear progressive phase factor along their length parallel to Y' and a smaller linear progressive phase factor perpendicular to their length along the X' axis. These two linear phase factors cause the radiated planar phase front x (FIG. 2C) from the antenna to make an angle with the mechanical boresight (along the z-axis) of the antenna that is dependent on $\Psi$. This leads to an antenna pattern whose main beam is shifted or scanned in space.

The amount of change in the linear progressive phase factors and correspondingly the amount of scan increases with increasing $\Psi$. Further, both plates 1 and 3 may be rotated simultaneously to scan the antenna beam in azimuth. Overall, the antenna beam may be scanned in elevation angle, $\theta$, from zero to ninety degrees and in azimuth angle, $\phi$, from zero to three hundred and sixty degrees through the differential and common rotation of plates 1 and 3 respectively. Moreover, the antenna beam may be continuously scanned in azimuth in a repeating three hundred and sixty-degree cycle through the continuous rotation of plates 1 and 3 simultaneously.

In general the required rotations for the above described embodiments may-be achieved through various means illustrated schematically in FIG. 2A as relative plate rotation apparatus 200 and common plate rotation apparatus 210, including but not limited to being belt driven, perimeter gear driven, or direct gear driven.

Thus, in this embodiment, a CTS antenna provides a relatively thin, two dimensionally scanned phased array antenna. This is accomplished through a unique variable phase feeding system whose incident phase fronts are fixed while scanning is achieved by mechanically inclining (rotating) a set of CTS stubs.

Figure 3A:
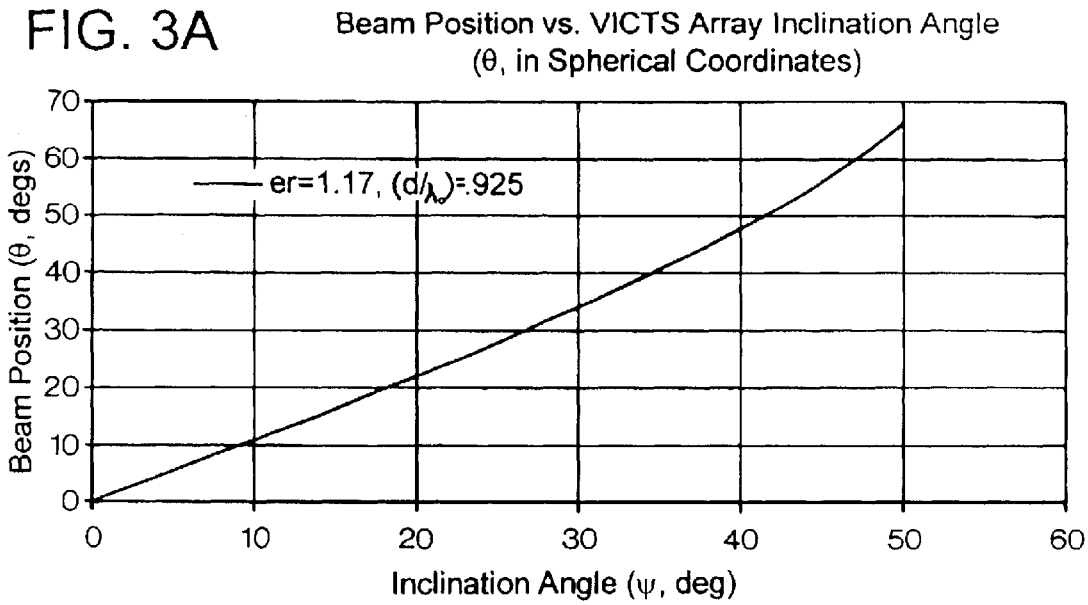
FIGS. 3A–3B are exemplary plots of beam position versus inclination angle for the embodiments of FIGS. 1A–2C.
Figure 3B:
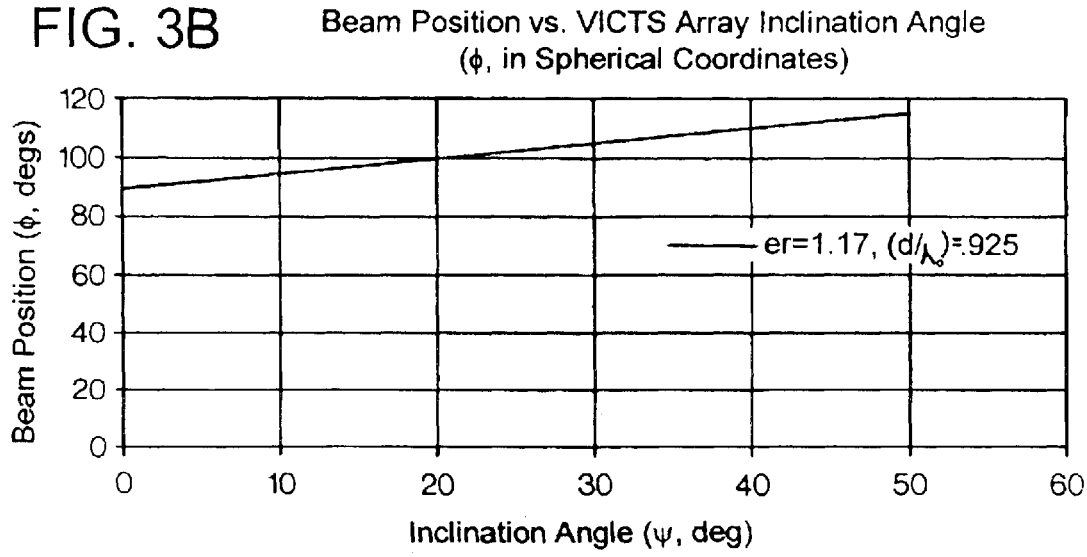

FIG. 3 illustrates the variation of antenna main beam position relative to the X'-Y' coordinate frame of reference in spherical coordinates ($\theta$, $\phi$) as a function of the differential rotation angle, $\Psi$, of plate 1 with respect to plate 3 for $d/\lambda_o$=0.925, $\epsilon_r$=1.17. As shown in FIG. 3, the vast majority of main beam scanning occurs in the $\theta$ direction while a relatively small amount of motion occurs in the $\phi$ direction. Primary scanning in the second dimension, $\phi$, may be achieved by simultaneously rotating plates 1 and 3. In this manner the main beam may be placed virtually anywhere within a hemisphere.

Figure 4:
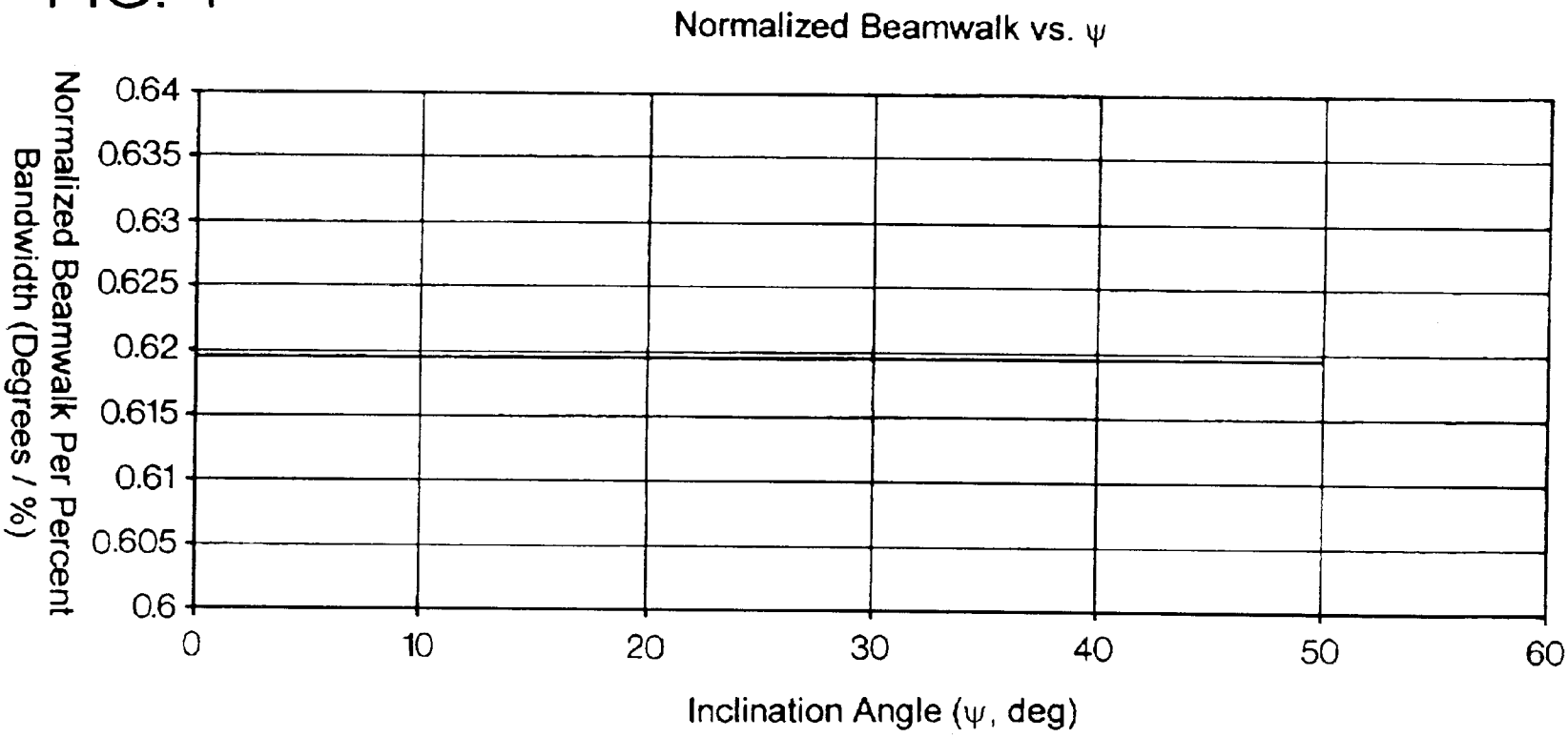
FIG. 4 is a plot of the normalized beamwalk per percent bandwidth versus inclination angle.

The Cosine factor is included to account for the increase in size of the main beam as the beam is scanned in increasing $\theta$ due to the corresponding decrease in effective aperture area. The Sine factor is included to account for the increase in $\phi$ as the beam is scanned to higher values of $\theta$. FIG. 4 shows a plot of BW expressed in degrees per percent bandwidth versus rotation angle, $\Psi$, for the same embodiment whose beam position is described in FIG. 3. As indicated in the plot, BW, the normalized beamwalk is virtually constant with respect to $\Psi$. This phenomena contrasts sharply with most fully populated phased arrays whose beam walk over frequency increases non-linearly. This property is particularly useful in applications that require minimum beamwalk at large scan angles.

In general, grating lobes or repeats of the main antenna beam, can exist when antenna element spacing exceeds one wavelength. Since the beam scan component in planes parallel to the length of the stub occurs as the result of a purely optical (or true time delay) phenomena, namely Snell=s law, involving a continuous source, no grating lobes will occur co-incident within this plane. The optical or true time delay phenomena refers to the feeding of the radiating continuous transverse stubs of the VITCS array in a manner analogous to the way in which an array of discrete elements may be fed with a corporate feed network (commonly referred to as a true time delay feed). In such a configuration, the corporate feed, which includes transmission lines, has a single input port and multiple output ports, where the number of output ports equal the number of discrete elements. The length of the transmission lines may be adjusted so that the antenna main beam radiating from the discrete array maintains a constant position in space independent of frequency. In the VITCS array, the discrete elements and transmission lines are replaced, in this analogy, by a long continuous transverse stub (CTS) element and a long continuous transverse electromagnetic (TEM) wave in a parallel plate respectively. Correspondingly, the antenna beam formed from the energy radiated from the long continuous stub will maintain a constant position in space independent of frequency.

Since the beam scan component in planes perpendicular to the length of the stub is a function of wavelength, element spacing, and rotation angle, under certain condition, grating lobes can exist in this plane. The two primary upper and lower grating lobe positions can be described mathematically using traditional array theory. The upper grating lobe will never enter visible space for the case where the relative dielectric constant is greater than 1. The lower grating lobe exists in visible space for element spacings greater than one wavelength for a rotation angle $\Psi$ of zero. However, the lower grating lobe will exit visible space for some predictable non-zero value of rotation angle leading to a limited usable grating lobe free scan volume. These phenomena, no upper grating lobe and a lower grating lobe that exits visible space at scan angles larger than zero, are unique to the VICTS embodiment. Further, these phenomena contrast sharply with traditional phased arrays where grating lobes are normally observed to enter visible space for large commanded scan angles.

As plate 1 is rotated to larger and larger $\Psi$ values, both the number of stubs radiating energy to free space and the amount of energy radiated to free space decreases. In the limit, if $\Psi$ reaches ninety degrees, none of the stubs interrupt the longitudinal surface currents flowing on the bottom surface of plate 1 and therefore no energy may be radiated into free space. As it is generally desirable to maintain a quasi-invariant amplitude distribution with respect to scan angle, the element spacing, the corrugation dimensions, and the stub dimensions are usually synthesized singularly and collectively to compensate for these potential reductions in radiated energy.

Figure 5:
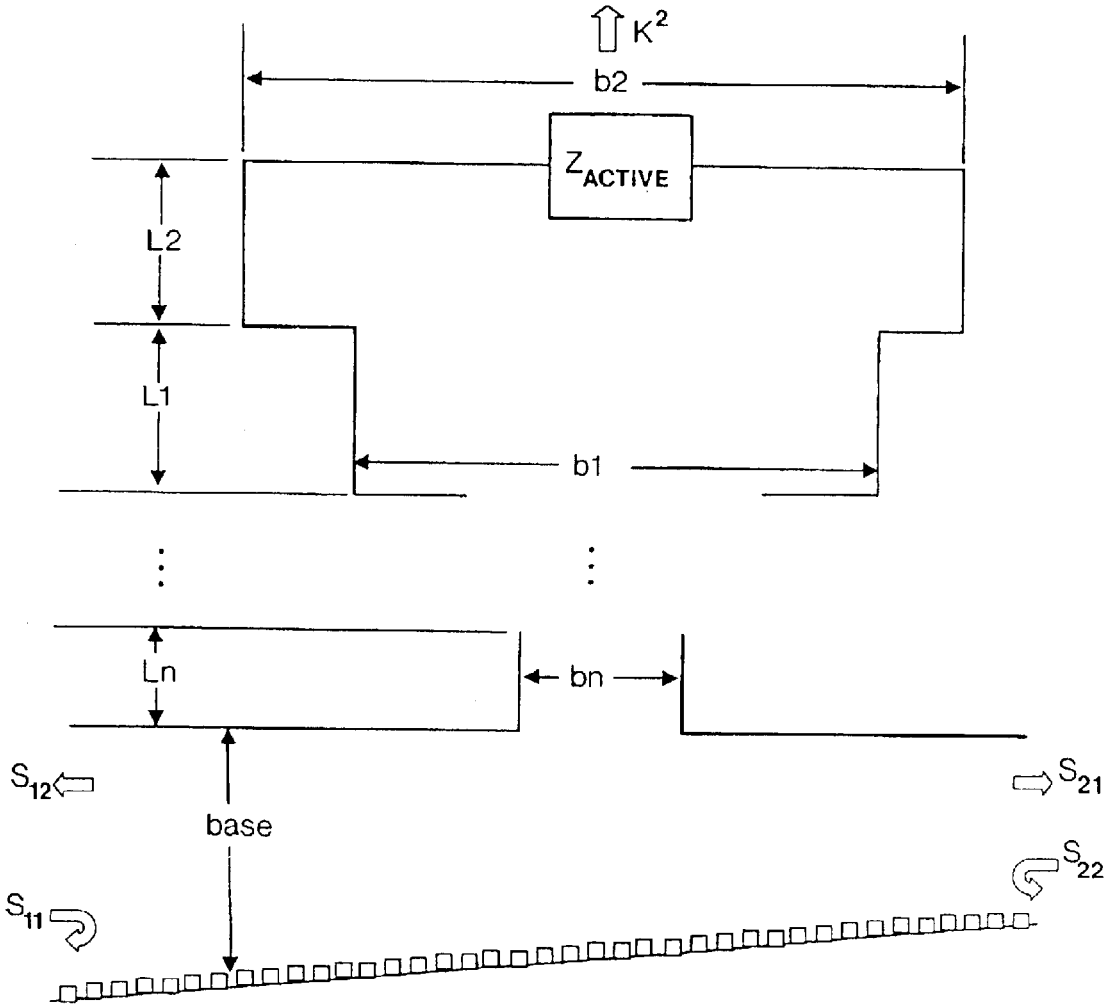
FIG. 5 illustrates an S-parameter model of an embedded VICTS element.

An embedded stub element may be sufficiently modeled using traditional electromagnetic analysis techniques such as Method of Moments, Mode Matching, and Finite Element Methods. Using these techniques along with standard transmission line theory, the embedded s-parameters (see FIG. 5) $S_{11}$, $S_{21}$, $S_{22}$, $S_{12}$, and the effective coupling factor $K^2$ ($K^2$ is proportional to the amount of power coupled to free space) may be predicted. FIG. 5 shows a cross-section view of a typical VITCS array element. As indicated, the radiating CTS stub is modeled by several parallel plate transmission line sections of length L1 through Ln, with plate separation b1 through bn. Each transmission line section (or "stage") exhibits a unique characteristic impedance proportional to its plate separation (b1 through bn) as defined by standard transmission line theory. The value of the characteristic impedance of a given section is defined as the ratio of voltage to current in the section. The load impedance indicated by "$Z_{active}$" in FIG. 5 serves to model the environment experienced by the stub in the presence of the other stubs that comprise the VITCS array. As indicated in FIG. 5, Ln and bn are used to model CTS radiating elements including more than two impedance stages. By judiciously selecting the stub dimensions and the stub spacing, the variation of $K^2$ with respect to rotation angle will be a quasi-constant, well-behaved continuous function.

Figure 6:
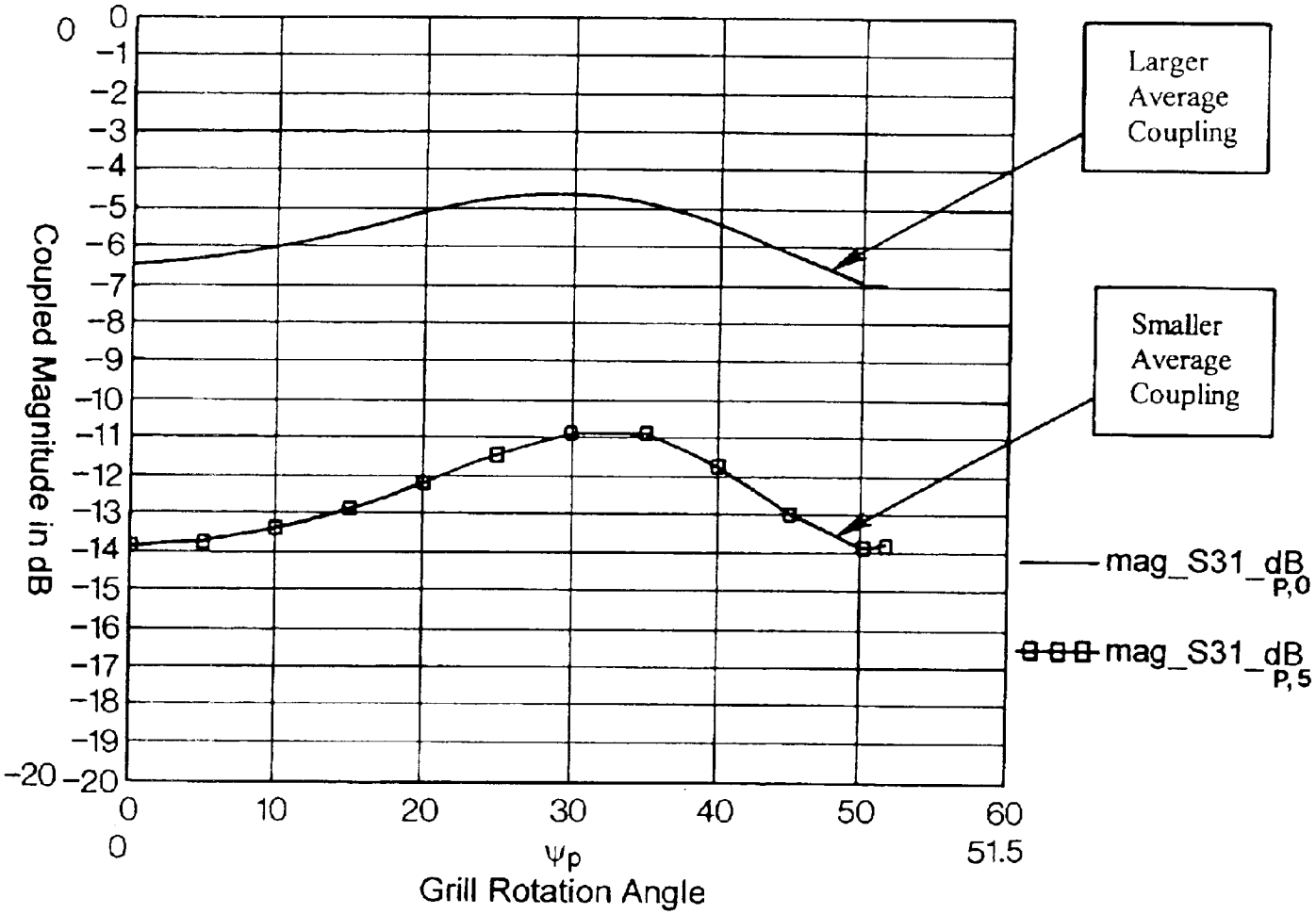
FIG. 6 is a plot of predicted effective coupling versus inclination angle.

FIG. 6 shows the predicted effective coupling, $K^2$, for different Abase@ dimensions versus rotation angle for a typical geometry. Note that for the larger average value coupling curve (corresponding to a shallow Abase@ dimension) the effective coupling is constant to within +/−1.5 dB.

Examples of embodiments with multiple impedance stages are shown in FIGS. 7A and 7B, which illustrate cross-sectional views of both an extrusion-based (FIG. 7A) and a solid or non-extrusion-based (FIG. 7B) multiple impedance stage CTS radiating stub, respectively. Radiating stubs with a single impedance stage may also be deployed and may be useful for certain applications.

Another unique result of the quasi-constant stub coupling for this exemplary embodiment is that the VICTS embodiment will not possess any scanning "blind zones," i.e., scan regions where element coupling is significantly reduced or non-existent, unlike some conventional two-dimensional scanning phased arrays.

The VICTS embodiment of FIGS. 1A–2C includes CTS stubs that possess constant radiating stub dimensions and variable parallel plate base dimensions. As plate 1 is rotated with respect to plate 3, the relative positions of all the stubs will change in such a way that the parallel plate separation for a given stub will be different than that at zero degrees rotation. Moreover the parallel plate separation will vary as a function of both X= and Y=. Since the effective coupling factor, $K^2$, is designed to be mostly constant with respect to rotation angle and varies only with plate separation, b, the overall coupling profile and corresponding amplitude distribution of the antenna will be mostly constant with respect to rotation angle. In this manner, the amplitude distribution is synthesized solely through the variation of the parallel plate separation, b, in lieu of variations in the radiating stub dimensions. This attribute reduces the manufacturing complexity of the upper plate 1 since all of the stub dimensions are identical except for their length. Other geometries in which the cross-sectional stub dimensions (L1 . . . Ln, and b1 . . . bn) are not identical among stubs can also be employed and may be desirable for some applications. Additionally, embodiments in which stubs are non-uniformly spaced (i.e., d is non-constant from stub to stub) are possible and may be desirable for some applications.

As illustrated in FIGS. 1 and 2, a choke mechanism, 11, is deployed to prevent spurious rf energy from escaping outside the physical boundaries of the antenna. A novel choke embodiment is shown in FIG. 8. In this embodiment, a coupled pair of CTS stubs 11A, 11B are deployed. The choke presents an extremely high impedance to any waves incident in the choke region such that $S_{11}$ and $S_{22}$ have magnitudes very close to one and $S_{12}$ and $S_{21}$ have magnitudes very close to zero (see FIG. 8). The choke provides good rf choking regardless of rotation angle and the choke performance may be designed to be virtually invariant with rotation angle over a given frequency range.

Figure 9A:
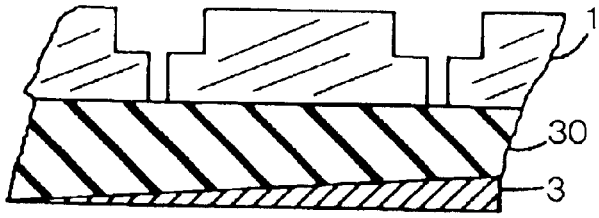
FIGS. 9A–9E depict alternative structures for achieving the dielectric constant between the plates 1 and 2.
Figure 9B:
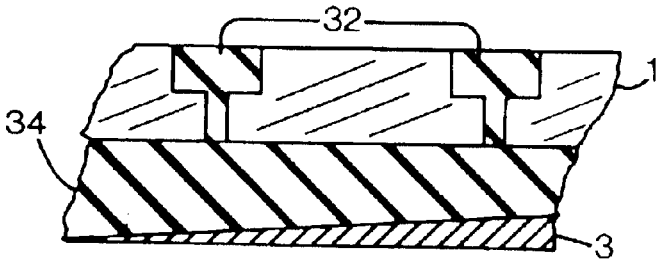
Figure 9C:
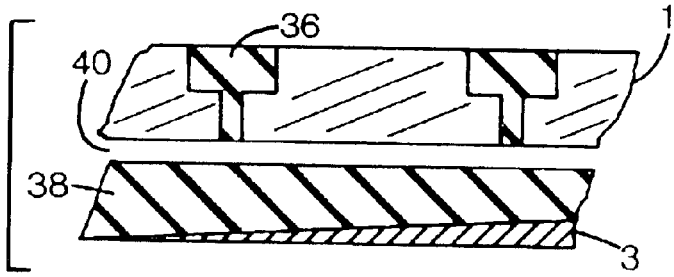
Figure 9D:
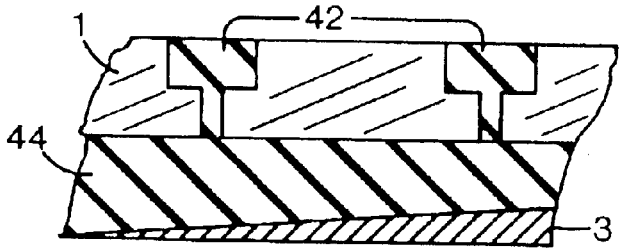
Figure 9E:
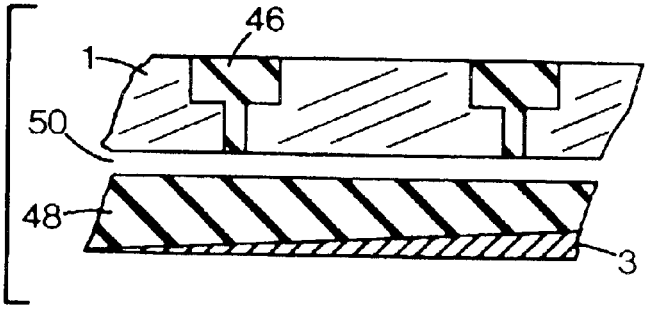

Alternative techniques may be used to load the region between the plates 1 and 3. FIGS. 9A–E show cut-away views of several possible embodiments including solid dielectric 30 in the parallel plate region (FIG. 9A), separate identical solid dielectrics 32, 34 in the stub and the plate regions (FIG. 9B), separate identical solid dielectrics 36, 38 in the stub and the plate region with an air gap (FIG. 9C), separate non-identical solid dielectrics 42, 44 in the stub and the plate region (FIG. 9D), and separate non-identical solid dielectrics 46, 48 in the stub and the plate region with an air gap 50 (FIG. 9E). Other geometries are possible and may be useful for certain applications.

Enhanced stub performance may be provided through the addition of single or multiple tuning elements. Tuning elements may be used to reduce the "input" mismatch, $S_{11}$ (see FIG. 5), of individual stub elements. In exemplary embodiments of a VITCS array, the tuning elements are designed for optimum performance over rotation angle. FIGS. 10A, 10B, 11A, 11B, 12A, 12B, 12C, and 12D show examples of tuner implementations 60, 62, 64, 66, 68A, 68B, 70A–70B, 72A–72B, 74A–74B. Multiple impedance stage tuning elements may also be implemented.

Figure 10A:
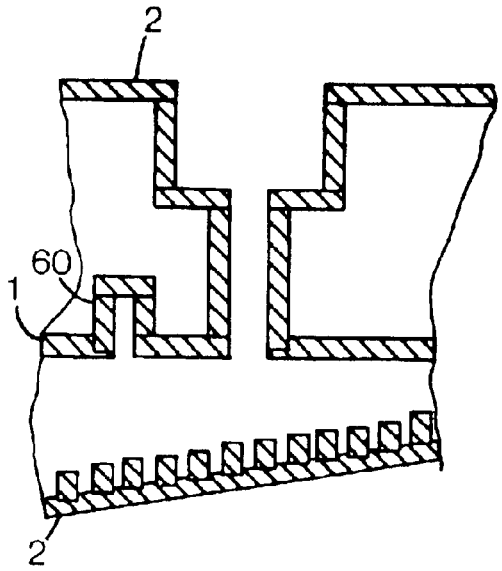
FIGS. 10A–10B show tuners deployed in "front" of a radiating CTS stub, i.e. in a feed energy signal path upstream of the stub.
Figure 10B:
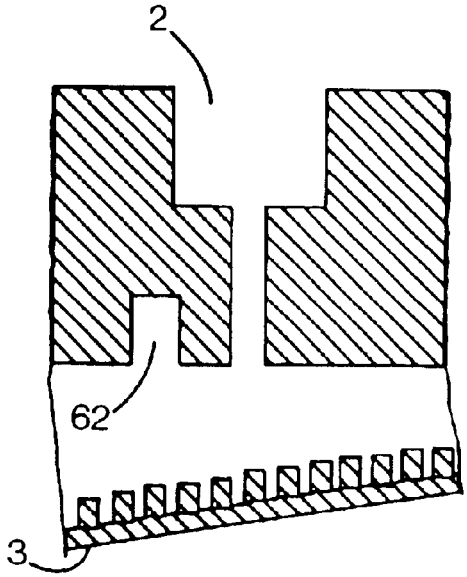

FIG. 10A shows an example of a radiating CTS stub element 2, implemented with a single stage tuning element 60 in "front" of the stub, in extrusion form. FIG. 10B shows an example of a radiating CTS stub element 2 implemented with a single impedance stage tuning element 62 in "front" of the stub, in solid form.

Figure 11A:
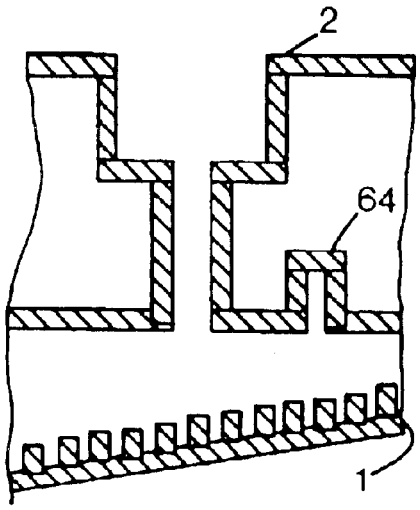
FIGS. 11A–11B show tuners deployed "behind" a radiating CTS stub, i.e. in a feed energy signal path downstream of the stub.
Figure 11B:
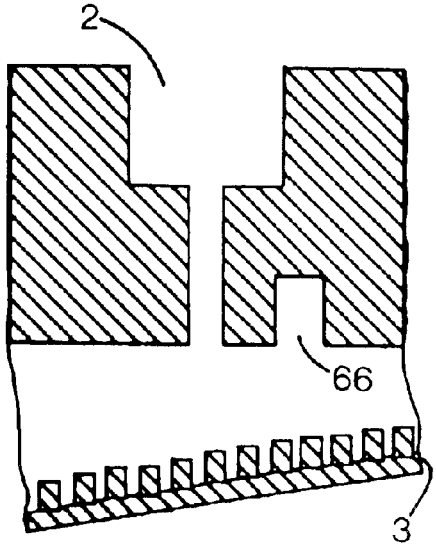

FIG. 11A shows an example of a radiating CTS stub element implemented with a single impedance stage tuning element 64 "behind" the stub, in extrusion form. FIG. 11B shows an example of a radiating CTS stub element 2 implemented with a single impedance stage tuning element 66 Abehind@ the stub, in solid conductive plate form.

Figure 12A:
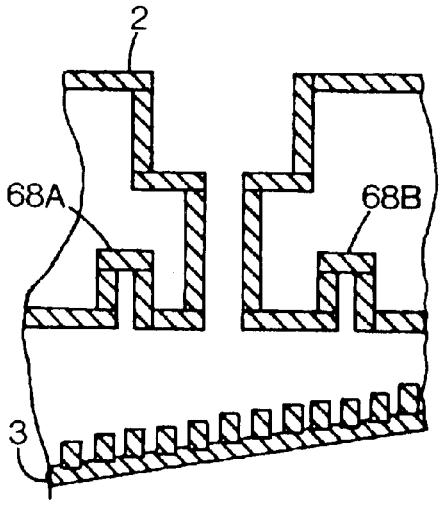
FIGS. 12A–12B illustrate tuners deployed on both sides of a CTS stub.
Figure 12B:
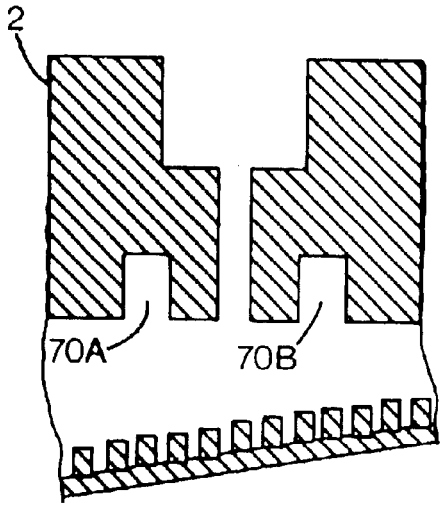

FIG. 12A shows an example of a radiating CTS stub element implemented with two single impedance stage tuning elements, one (68A) in "front" of and the other (68B) "behind" the stub, in extrusion form. FIG. 12B shows an example of a radiating CTS stub element implemented with two single impedance stage tuning elements, one (70A) in "front" of and the other (70B) "behind" the stub, in solid conductive plate form.

The tuning elements illustrated in FIGS. 10A through 12B may be designed for optimum performance over rotation angle using electromagnetic analysis techniques such as transmission line theory, Finite Element Methods, and Method of Moments.

Figure 12C:
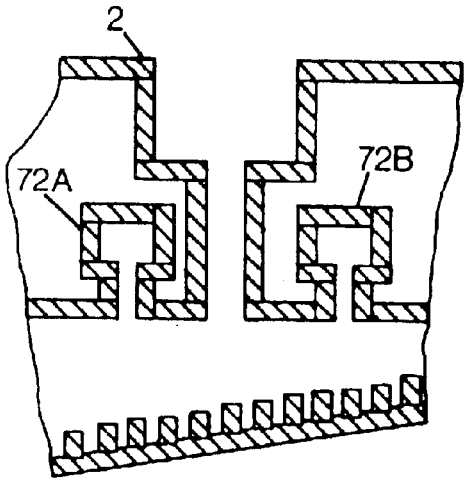
Figure 12D:
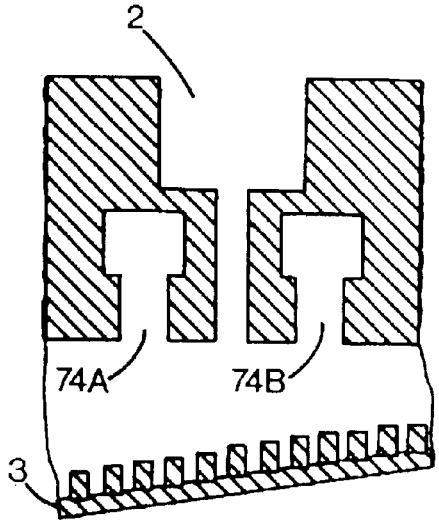

FIG. 12C illustrates an example of a radiating CTS stub element implemented with two double impedance stage tuning elements, one (72A) in "front" of and the other (72B) "behind" the stub, in extrusion form. FIG. 12D shows an example of a radiating CTS stub element implemented with two double impedance stage tuning elements, one (74A) in "front" of and the other (74B) "behind" the stub, in solid conductive plate form.

Configurations that combine both tuning elements (either single or multiple, e.g. as depicted in FIGS. 10–12) and techniques for loading the space between the plates (e.g. as depicted in FIGS. 9A–9E) may be useful in some applications. Other tuner configurations may be useful in some applications.

Further, if the dimensions and locations of the tuners are properly chosen, the tuners may be used to either increase or decrease the coupling of the stub element. Coupling values of 3 dB or higher are possible.

The VICTS retains advantages of previous CTS systems including robust tolerance sensitivities. The junction formed at the interface of the radiating stub and the parallel plate is inherently broad band. This junction, combined with the multi-stage-radiating stub, comprises a radiating antenna element whose tunable bandwidth may be designed to be greater than thirty percent. Higher tunable bandwidths are possible through the addition of more stages to the radiating stub as shown in FIGS. 7A and 7B. Examples of other possible embodiments involving non-linear lower plate variations, dielectric materials, and dielectric materials with air gaps are shown in FIGS. 13, 14, and 15 respectively.

Figure 13A:
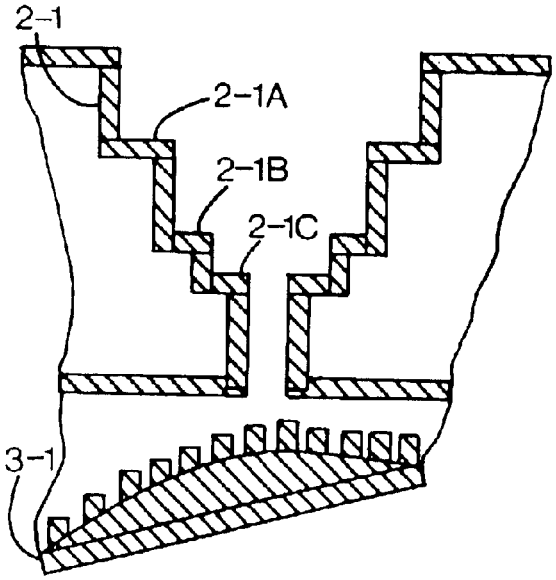
FIGS. 13A–13B illustrate embodiments having non-linear plate variations.
Figure 13B:
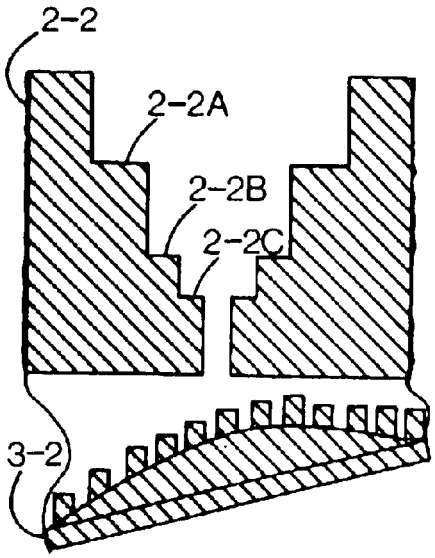

FIG. 13A illustrates an example of a multiple impedance stage radiating element with a non-linearly shaped base 3-1, in extrusion form. FIG. 13B is another example of a multiple impedance stage radiating element 2-2, with stages 2-2A, 2-2B, 2-2C, with a non-linearly shaped base 3-2, in solid conductive plate form.

Figure 14A:
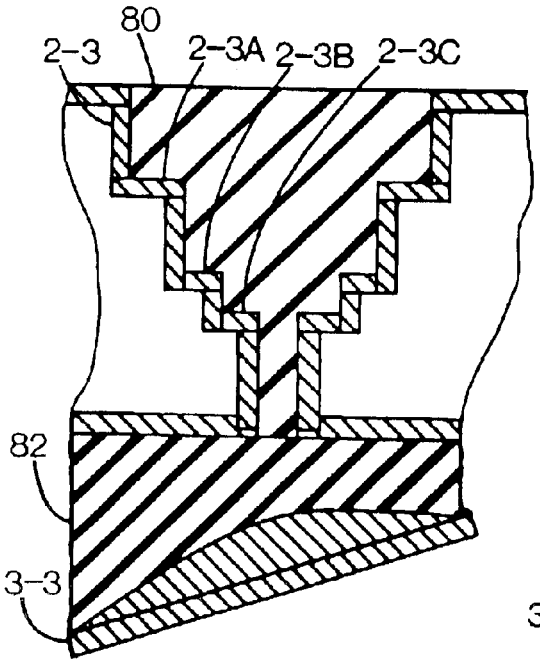
FIGS. 14A–14B illustrate embodiments having non-linear plate variations and dielectric materials.
Figure 14B:
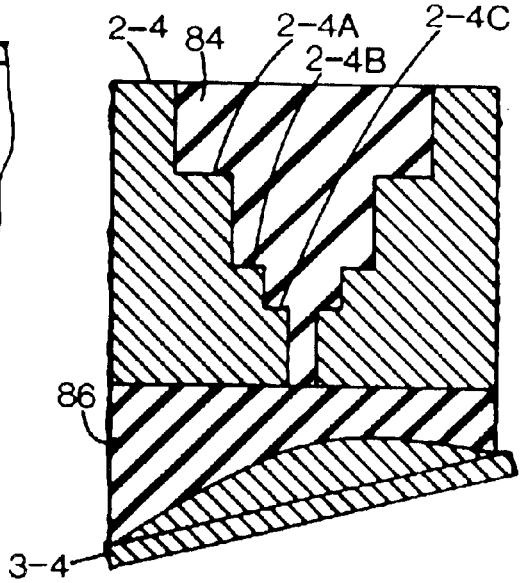

FIG. 14A illustrates an example of a multiple impedance stage radiating element 2-3, with stages 2-3A, 2-3B, 2-3C, with a non-linearly shaped base 3-3, in extrusion form, where the radiating stub is filled with dielectric material 80 and the base region is filled with a different dielectric material 82. FIG. 14B is another example of a multiple impedance stage radiating element 2-4 with a non-linearly shaped base 3-4, in solid conductive plate form, where the radiating stub, with stages 2-4A, 2-4B, 2-4C, is filled with dielectric material 84 and the base region is filled with a different dielectric material 86.

Figure 15A:
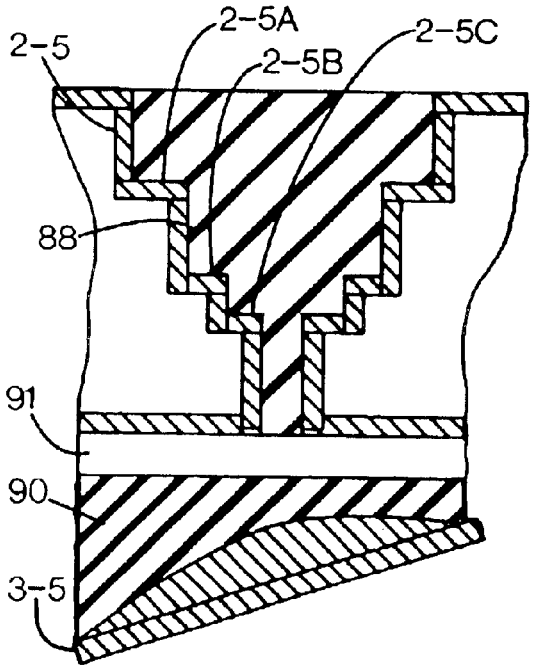
FIGS. 15A–15B illustrate embodiments having non-linear plate variations, dielectric materials and air-gaps.

FIG. 15A illustrates an example of a multiple impedance stage radiating element 2-5 with a non-linearly shaped base 3-5, in extrusion form, where the radiating stub is filled with dielectric material 88 and the base region is filled with a different dielectric material 90, separated by an air gap 91.

Figure 15B:
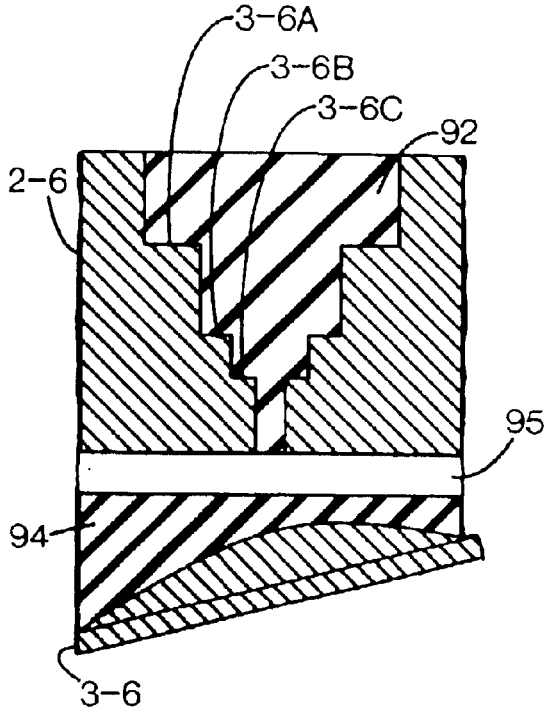

FIG. 15B is another example of a multiple impedance stage radiating element 2-6 with a non-linearly shaped base 3-6, in solid conductive plate form, where the radiating stub, with stages 3-6A, 3-6B, 3-6C is filled with dielectric material 92 and the base region is filled with a different dielectric material 94, separated by an air gap 95.

The height profile (in the z-direction) of the upper surface of the lower plate 3 may be modified from the embodiment of FIGS. 1A–2C (continuous monotonically increasing) to achieve various coupling profiles. Stepped or discontinuous profiles (FIG. 16), shaped profiles (FIG. 17), and flat profiles (FIG. 18) are examples. Profiles of arbitrary shape are possible and may be useful for some applications.

Figure 16:
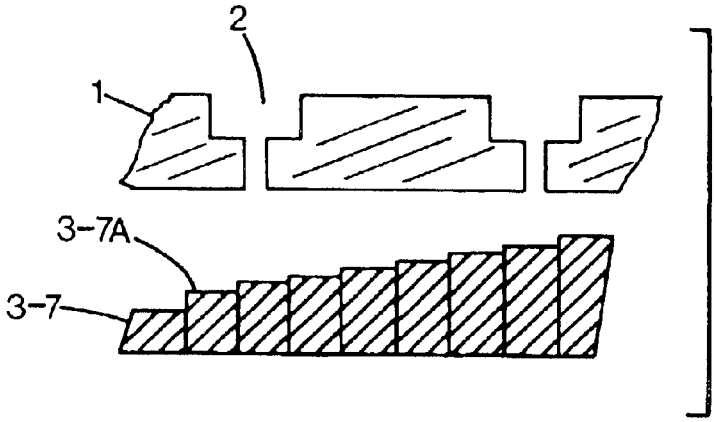
FIG. 16 illustrates an embodiment having a stepped lower plate profile.

FIG. 16 is a cross-sectional view of a portion of an upper conductive plate 1 including two CTS radiating stubs 2 and a cross sectional view of a portion of a lower conducting plate 3-7. The illustrated portion of this lower plate differs from the embodiment of FIG. 1A in that it includes a set of stepped conductive regions 3-7A rather than one continuous conductive region.

Figure 17:
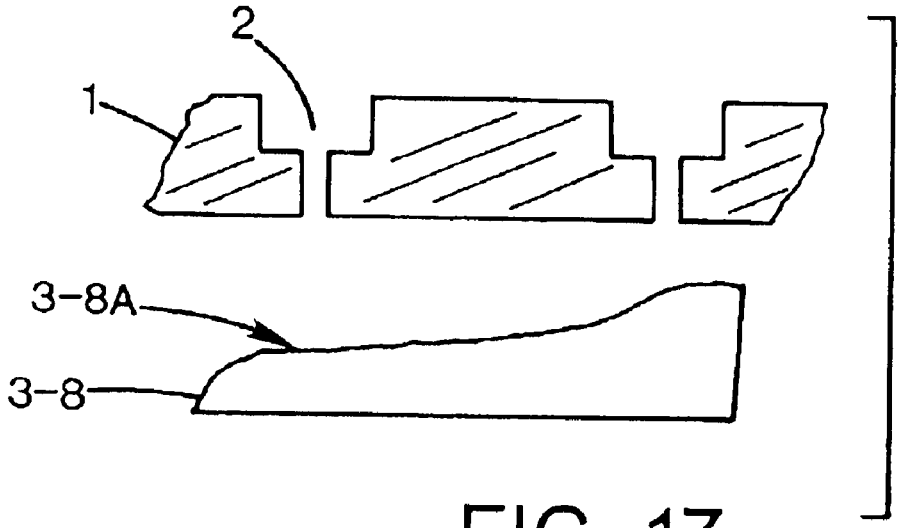
FIG. 17 illustrates an embodiment having a shaped lower plate profile.

FIG. 17 is a cross-sectional view of a portion of an upper conductive plate 1 including two CTS radiating stubs 2 and a portion of a lower conductive plate 3-8. The illustrated portion of this lower plate 3-8 differs from the embodiment of FIG. 1B in that it includes a non-linear conductive region 3-8A rather than one continuous monotonically increasing linear conductive region.

Figure 18:
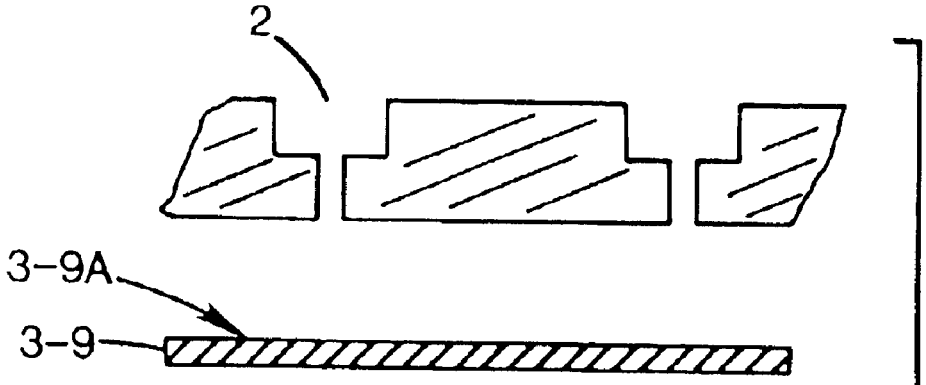
FIG. 18 illustrates an embodiment having flat lower plate profile.

FIG. 18 is a cross-sectional view of a portion of an upper conductive plate 1 including two CTS radiating stubs 2 and a portion of a lower conductive plate 3-9. The illustrated portion of this lower plate 3-9 differs from the embodiment of FIG. 1B in that it includes constant non-varying conductive regions rather than one continuous monotonically increasing linear conductive region.

Figure 19A:
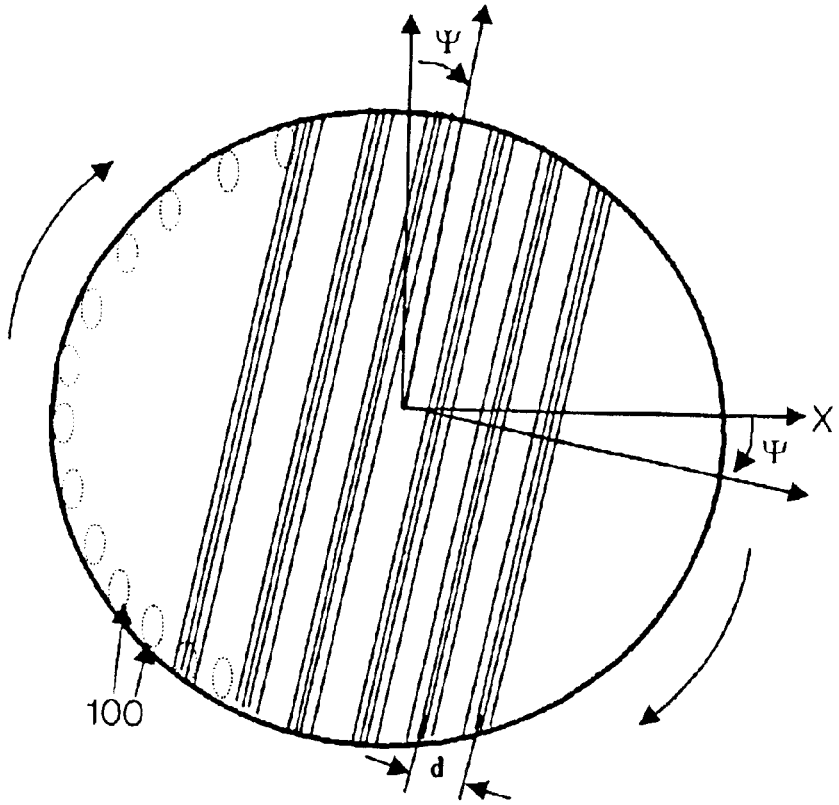
FIGS. 19A–19B illustrate an embodiment employing signal feeding around the perimeter with electromagnetic slots.
Figure 19B:
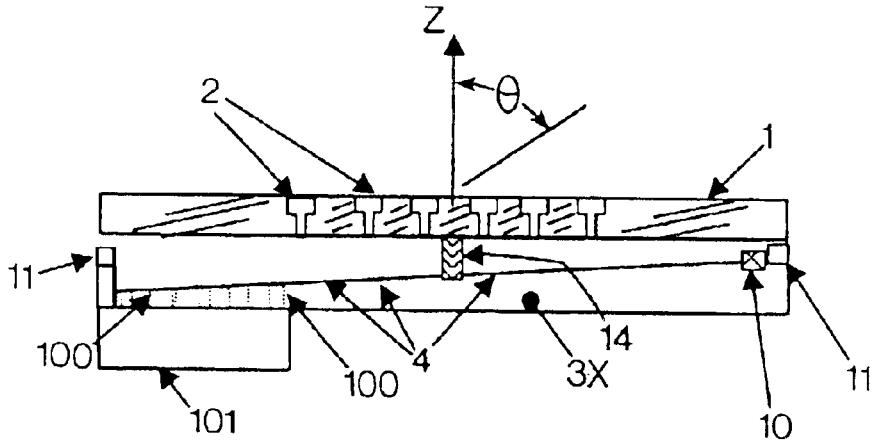

The feeding of the VICTS array may be accomplished through many techniques. Examples of feeds other than that described in the embodiment of FIGS. 1A–2C are shown in FIGS. 19A–19D, and 20. FIGS. 19A–19B show an alternate embodiment wherein a lower portion of plate 3 has been replaced with a lower portion 3X in which the long straight slot 8 of FIG. 1B has been replaced with a set of slots 100 below the perimeter of the radiating stubs. Electromagnetic energy is distributed through the slots 100 from below by generic source 101. The phenomena of electromagnetic wave propagation between upper plate 1 and lower plate 3X is analogous to that described above for the embodiment of FIGS. 1A–1C.

Figure 19C:
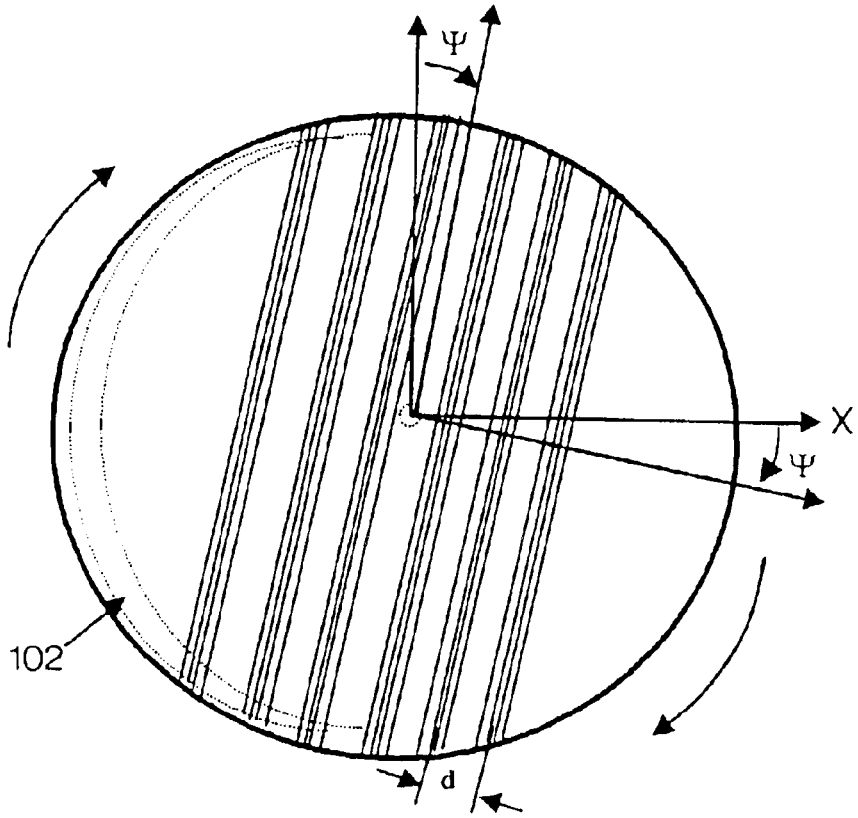
FIGS. 19C–19D illustrate an embodiment employing signal feeding around the perimeter with a single non-uniform electromagnetic slot.
Figure 19D:
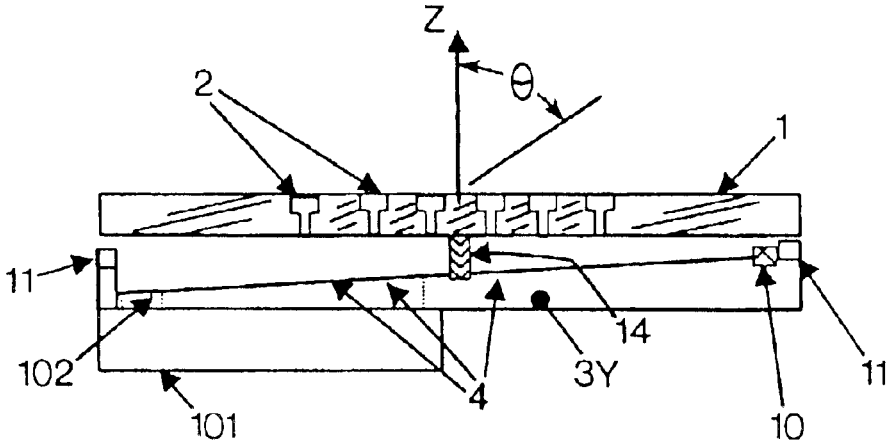

FIGS. 19C–19D show an alternate embodiment where a lower portion 3 has been replaced with a lower portion 3Y in which the long straight slot 8 of FIG. 1B has been replaced with a curved slot. Electromagnetic energy is distributed through a slot 102 from below by a generic source 101. The phenomena of electromagnetic wave propagation between upper plate 1 and lower plate 3Y is analogous to that described above for the embodiment of FIGS. 1A–1C.

Figure 20:
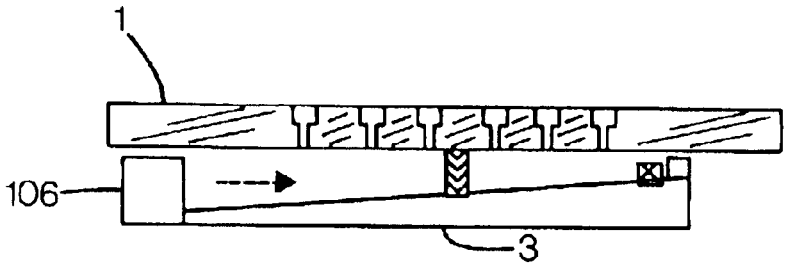
FIG. 20 illustrates an embodiment employing feeding with a generic source disposed at a side of the parallel plate region.

FIG. 20 indicates a generic source 106 disposed on the side of the parallel plate region rather than the bottom.

Figure 21:
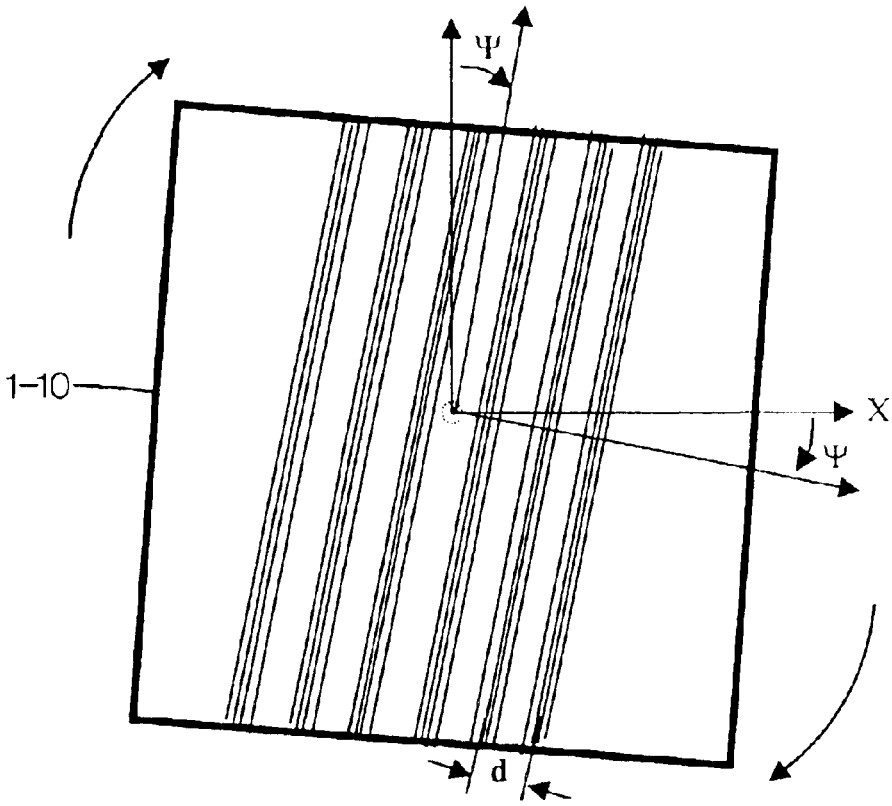
FIG. 21 illustrates an embodiment employing feeding to a square shaped upper plate.
Figure 22:
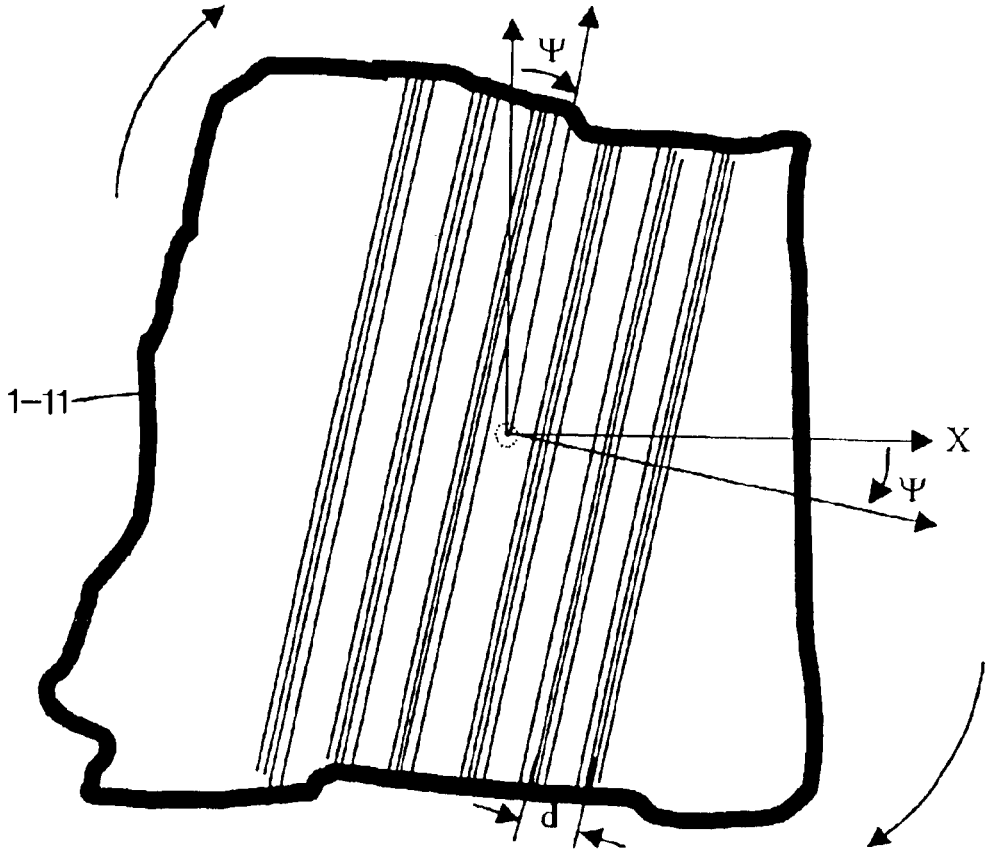
FIG. 22 illustrates an embodiment employing feeding to an arbitrarily-shaped upper plate.

FIGS. 1A and 2A indicate a round (circular) upper conductive plate 1. Plate 1 may be replaced with alternatively shaped plates, e.g. including rectangular plates 1-10 and irregularly shaped plates 1-11 as indicated in FIGS. 21–22. Other shapes for the plate can alternatively be employed.

Figure 23A:
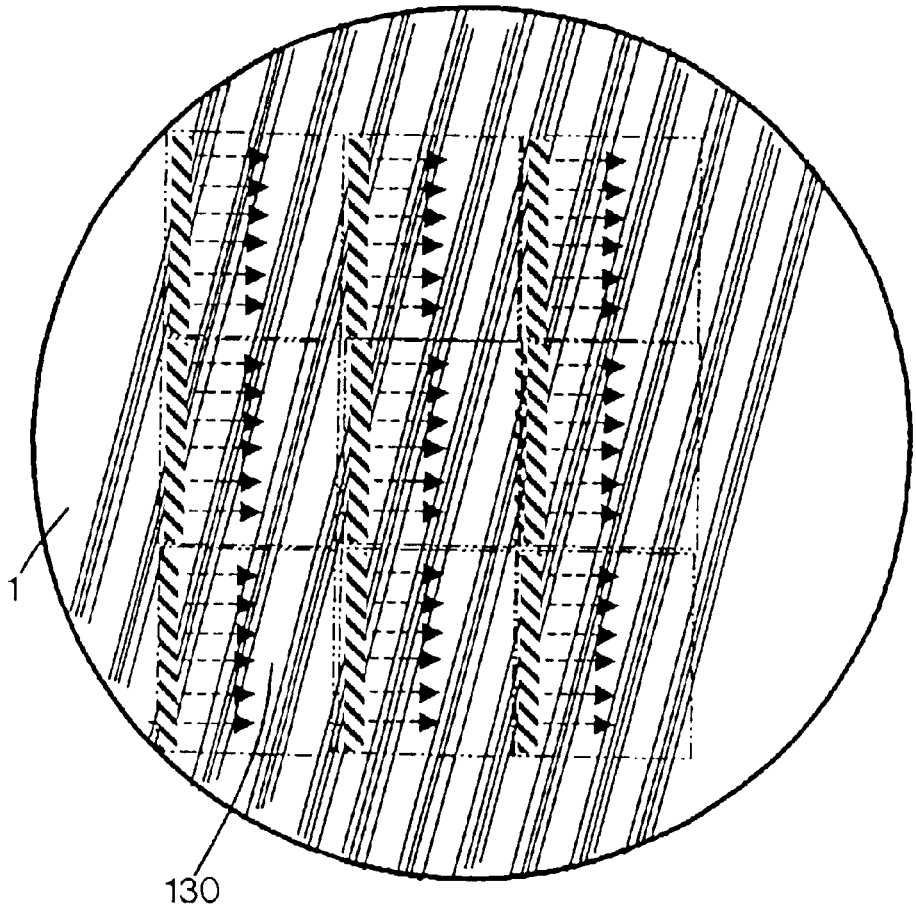
FIGS. 23A–23B illustrates an embodiment employing subarrayed feeding.
Figure 23B:
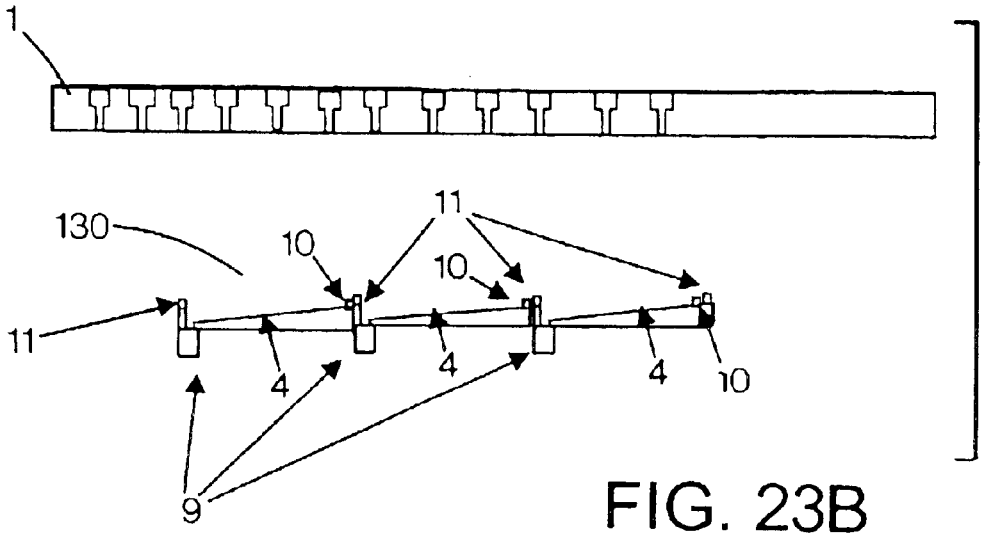

The VICTS antenna may be fed with multiple feeding regions referred to here as subarrays. Each subarray in the feed is a miniature version of the lower plate described above regarding FIGS. 1A–2C. Also included for each subarray are chokes 11, a linear generic source 9, corrugated surface 4, and load 10, as shown in FIGS. 23A and 23B. FIGS. 23A and 23B show a total of nine rectangular shaped subarray feed regions arranged in a rectangular lattice. Other arrangements including more or less subarrays could also be employed. Alternatively, other arrangements with a non-rectangular lattice and/or non-rectangular shaped subarrays are other alternate embodiments. FIGS. 23A and 23B show an upper conductive plate embodiment with twelve CTS radiating stubs, although other arrangements with more or less stubs could alternatively be employed.

Figure 24:
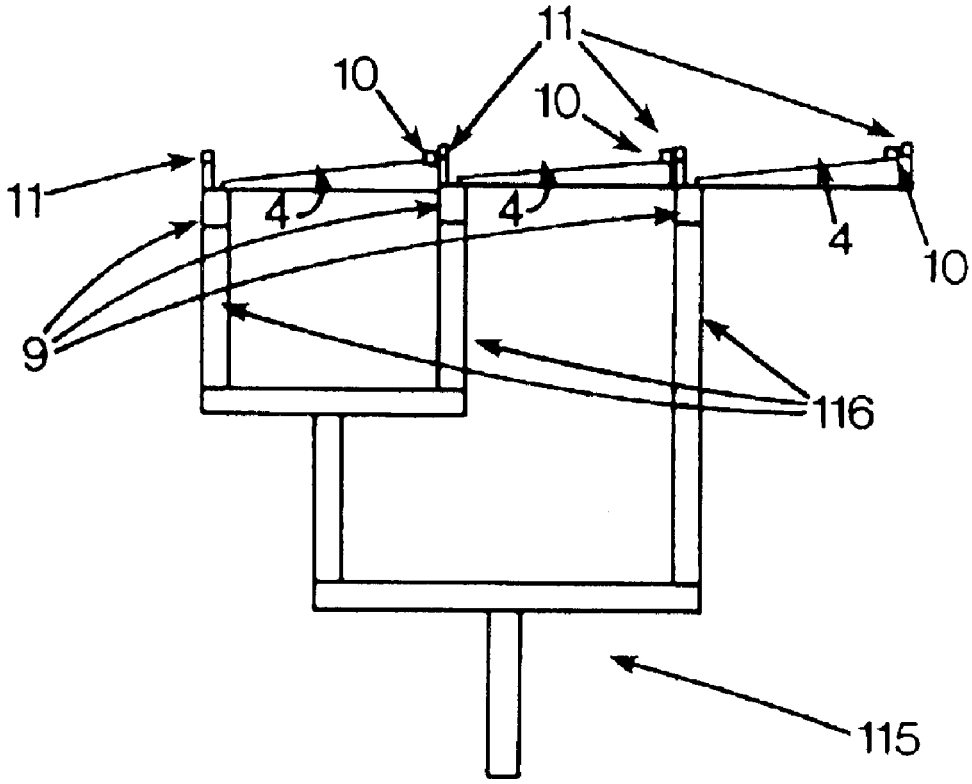
FIG. 24 illustrates an embodiment employing true time delay feeding of a subarrayed VICTS array.

The subarray arrangement of FIGS. 23A–23B may be combined with a true time delay (TTD) feed to achieve lower antenna main beam movement with respect to rotation angle, $\Psi$, and frequency than that achieved with a non-subarrayed VICTS. In such an embodiment, the collective sources are fed with a corporate TTD feed network. The TTD feed may be designed using electromagnetic analysis techniques such as the Finite Elements Method. FIG. 24 shows an embodiment similar to that shown in FIG. 23B combined with a generic TTD corporate feed network 115. Here a TTD feed with three feeding arms 116 is shown feeding three subarrays. Other arrangements containing more or less subarrays and more or less feeding arms 116 could alternatively be employed.

A TTD feed or other feeds of arbitrary configuration may be synthesized and combined with the VICTS embodiment to receive and transmit antenna patterns with multiple or single nulls (difference patterns). Feeds may also be synthesized such that the amplitude distribution of the composite VICTS antenna may be controlled globally through the independent weighting of the amplitude distribution in the feed. Antenna performance may be further enhanced through the addition of phase control elements (e.g., Phase Shifter, Transmit/Receive module, etc.) disposed between the output port of each arm of a feed and the input port of each subarray. In this manner virtually arbitrary antenna performance characteristics may be synthesized through the design of both the feed and the VICTS antenna.

Figure 25A:
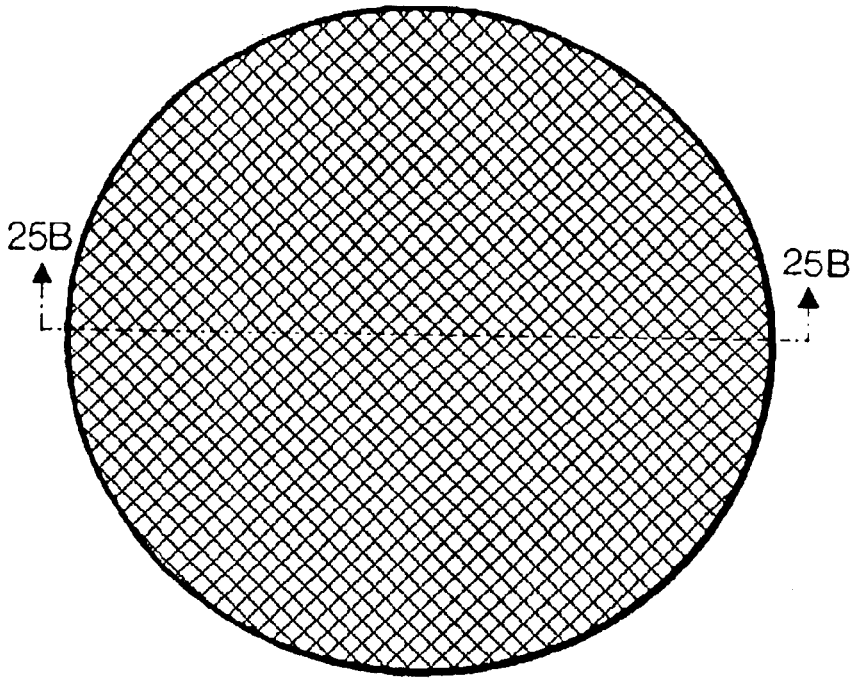
FIGS. 25A–25B illustrate an embodiment employing a two layer polarizer to transmit and receive circular polarization.
Figure 25B:
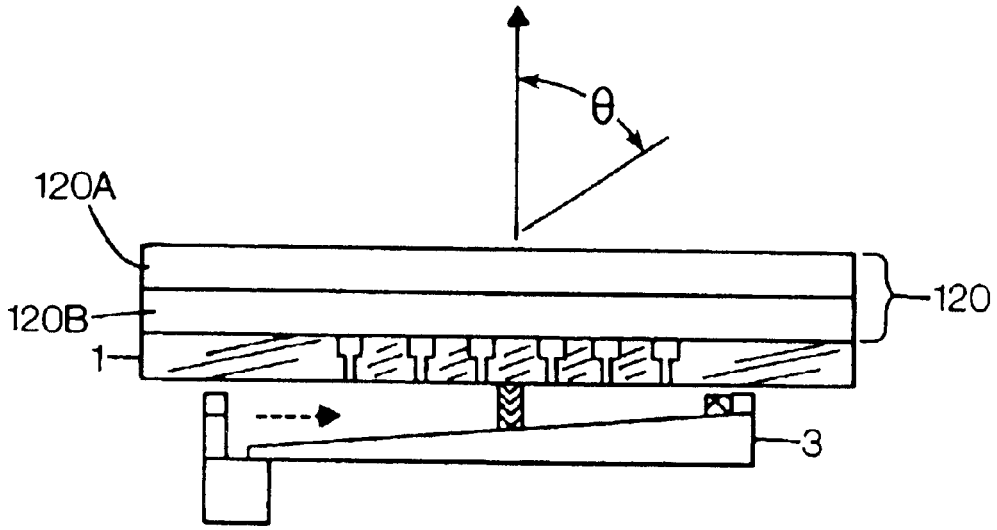

In general, VICTS embodiments including but not limited to the embodiment of FIGS. 1A–2C, the subarrayed embodiment, and the subarrayed embodiment with corporate feeding may be modified through the addition of single or multiple layer polarizers to transmit and receive a variety of rf signals including but not limited to signals possessing elliptical polarization, right-hand circular polarization (RHCP), left-hand circular polarization (LHCP), and variable linear polarization. FIGS. 25A–25B show an example of an embodiment implemented to transmit and receive circular polarization using a two-layer polarizer 120. In this embodiment, a VICTS antenna comprising a conductive plate 1 and a lower conductive plate 3 radiates linear polarized electromagnetic waves. As these radiated waves move away from the conductive plate 1, they impinge upon the polarizer comprising a first layer 120B and a second layer 120A. As the linearly polarized electromagnetic waves propagate through the polarizer 120, their polarization is changed from linear to circular. Upon leaving the top surface of the top layer 120A, the electromagnetic waves are circularly polarized and radiate into space. The polarizer may be designed using electromagnetic analysis techniques, e.g. Method of Moments, Mode Matching, and the Finite Element Method. Other polarizer geometries, e.g. with more or fewer layers, are possible and may be useful in certain applications.

FIGS. 26A–26B shows an example embodiment where one half of a VICTS array receives and transmits Right Hand Circularly Polarized (RHCP) signals and one half receives and transmits Left Hand Circularly Polarized (LHCP) signals. In this embodiment, one portion 130A of the polarizer is designed to convert a linear polarized signal to RHCP on transmit and to convert a RHCP signal to a linear polarized signal on receive. The other portion 130B of the polarizer is designed to convert a linear polarized signal to LHCP on transmit and to convert a LHCP signal to a linear polarized signal on receive. Feed 1 excites one half of the array for RHCP transmission and Feed 2 excites the other half of the array for LHCP transmission.

If the dimensions of the CTS stubs of plate 1, the separation between plates 1 and 3, and corrugation dimensions are chosen properly, the VICTS may operate at two frequency bands simultaneously. Further, the VICTS may be fed with a dual band feeding system 140 to accommodate the dual band VICTS array, as shown in FIG. 27.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An antenna array employing continuous transverse stubs as radiating elements, comprising:

an upper conductive plate structure comprising a set of continuous transverse stubs;

a lower conductive plate structure disposed in a spaced relationship relative to the upper plate structure, said lower plate structure having an upper surface whose spacing from a lower surface of the upper plate varies in a first direction parallel to said lower surface; and relative rotation apparatus for imparting a relative rotational movement between said upper plate structure and said lower plate structure.

2. The array of claim 1, further including an RF signal source for feeding the array with RF signals.

3. The array of claim 2, wherein the upper plate structure further includes an impedance tuning structure for each stub.

4. The array of claim 3, wherein the impedance tuning structure includes a tuning element upstream of each stub relative to a direction of feed energy propagation.

5. The array of claim 4, wherein the impedance tuning structure further includes a tuning element downstream of each stub relative to said direction of feed energy propagation.

6. The array of claim 3, wherein the impedance tuning structure includes a tuning element downstream of each stub relative to a direction of feed energy propagation.

7. The array of claim 1, further comprising a choke structure between the upper conductive plate structure and the lower conductive plate structure for preventing unwanted escape of spurious RF energy outside boundaries of the antenna array.

8. The array of claim 7, wherein the choke structure comprises:

a coupled pair of continuous transverse stubs disposed in a choke region.

9. The array of claim 8, wherein the coupled pair of stubs define a choke circuit presenting high impedance to RF waves incident in the choke region.

10. The array of claim 1, wherein said upper surface of said lower plate structure includes a set of corrugations to define a slow wave structure.

11. The array of claim 10, wherein said corrugations extend transverse to said first direction.

12. The array of claim 11, wherein said corrugations have respective depths which vary according to the spacing between the upper conductive plate structure and the lower conductive plate structure.

13. The array of claim 1, wherein said upper plate structure is fabricated of a solid conductive plate.

14. The array of claim 1, wherein said upper plate structure comprises a set of closely spaced elongated conductive extrusions, held together by a conductive frame structure.

15. The array of claim 1, further comprising an RF signal source for feeding the array with RF energy, the RF source disposed adjacent to an input region of a region between the upper plate structure and the lower plate structure, and an RF load disposed in a region distal from the input region for absorbing RF energy not radiated into free space by the array.

16. The array of claim 1, further comprising common rotation apparatus for commonly rotating the upper plate structure and the lower plate structure.

17. The array of claim 1, further including a layer of a dielectric material disposed between said upper plate structure and said lower plate structure.

18. The array of claim 17, further including an air gap between the upper plate structure and the layer of dielectric material.

19. The array of claim 1, further including a dielectric material disposed in cavities defined in said stubs.

20. The array of claim 1, further including:

a layer of a first dielectric material disposed between said upper plate structure and said lower plate structure;

a second dielectric material disposed in cavities defined in said stubs, said second dielectric material different from said first dielectric material.

21. The array of claim 1, wherein the upper surface of the lower plate structure has a non-linearly shaped profile in said first direction, and said spacing is not a linear function of distance along said first direction.

22. The array of claim 21, further including a layer of a dielectric material disposed between said upper plate structure and said lower plate structure.

23. The array of claim 21, wherein said upper surface of said lower plate structure includes a set of corrugations to define a slow wave structure.

24. The array of claim 1, wherein the upper surface of the lower plate structure has a stepped profile in said first direction.

25. The array of claim 1, including an RF feed structure comprising a linear elongated slot formed in said lower plate structure for launching RF energy into a region between said upper plate structure and said lower plate structure.

26. The array of claim 1, including an RF feed structure comprising a plurality of slots formed in said lower plate structure in an arcuate path for launching RF energy into a region between said upper plate structure and said lower plate structure.

27. The array of claim 1, including an RF feed structure comprising a elongated arcuate slots formed in said lower plate structure in an arcuate path for launching RF energy into a region between said upper plate structure and said lower plate structure.

28. The array of claim 1, wherein said upper plate structure and said lower plate structure have a circular array peripheral configuration in a plane perpendicular to an axis of rotation.

29. The array of claim 1, wherein said upper plate structure and said lower plate structure have a generally rectangular array peripheral configuration in a plane perpendicular to an axis of rotation.

30. The array of claim 1, wherein said upper plate structure and said lower plate structure have an irregular peripheral configuration in a plane perpendicular to an axis of rotation.

31. The array of claim 1, wherein said lower conductive plate structure comprises a plurality of subarray plate structures, the array further comprising for each subarray structure a feed structure for separately feeding said subarray structure with RF energy.

32. The array of claim 31, wherein said feed structure comprises a corporate true time delay feed network.

33. The array of claim 1, further comprising a polarizer structure disposed over the first plate structure to change the polarization of RF energy transmitted from the array.

34. The array of claim 33, wherein the polarizer structure comprises a polarizer structure for changing from linear polarization to circular polarization.

35. The array of claim 34, wherein the polarizer structure includes a first polarizer structure for changing from linear polarization to right hand circular polarization over a first array region, and a second polarizer structure for changing from linear polarization to left hand circular polarization over a second array region.

36. The array of claim 1, further comprising a dual frequency band feed system for feeding the array with RF energy in two different frequency bands.

37. A Variable Inclination Continuous Transverse Stub (VICTS) array comprising:

a first plate structure comprising a one-dimensional lattice of continuous radiating stubs;

a second plate structure comprising one or more line sources emanating into a parallel-plate region formed and bounded between the first and second plate structures;

an apparatus for imparting relative rotational movement between the upper plate structure and the lower plate structure, whereby said rotation acts to vary the inclination of incident parallel-plate modes relative to the continuous radiating stubs in the upper plate, and in doing so constructively exciting a radiated planar phase-front whose angle relative to a mechanical normal of the array is a function of a relative angle of differential mechanical rotation between the two plates; and a choke structure between the first plate structure and the second plate structure for preventing escape of spurious TR energy outside boundaries of the array.

38. The array of claim 37, further comprising apparatus for producing common rotation of the first plate structure and the second plate structure in unison to steer an array beam in an azimuth direction.

39. The array of claim 37, further comprising a choke structure between the first plate structure and the second plate structure for preventing escape of spurious RF energy outside boundaries of the array.

40. The array of claim 37, wherein the choke structure comprises:

a coupled pair of continuous transverse stubs disposed in a choke region.

41. The array of claim 40, wherein the coupled pair of stubs define a choke circuit presenting high impedance to RF waves incident in the choke region.

42. The array of claim 37, wherein an upper surface of said second plate structure includes a set of corrugations to define a slow wave structure.

43. The array of claim 42, wherein said corrugations extend transverse to a first direction parallel to a lower surface of said first plate structure.

44. The array of claim 43, wherein said corrugations have respective depths which vary according to a spacing between the first plate structure and the second plate structure.

45. The array of claim 37, wherein said first plate structure is fabricated of a solid conductive plate.

46. The array of claim 37, wherein said first plate structure comprises a set of closely spaced elongated conductive extrusions, held together by a conductive frame structure.

47. The array of claim 37, further comprising an RF load disposed in a region distal from said one or more line sources for absorbing RF energy not radiated into free space by the array.

48. The array of claim 37, wherein the first plate structure further defines an impedance tuning structure for each stub.

49. The array of claim 37, further including a layer of a dielectric material disposed between said first plate structure and said second plate structure.

50. The array of claim 49, further including an air gap between the first plate structure and the layer of dielectric material.

51. The array of claim 37, further including a dielectric material disposed in cavities defined in said stubs.

52. The array of claim 37, wherein an upper surface of the second plate structure has a non-linearly shaped profile in first direction parallel to a lower surface of said first plate structure, and spacing is not a linear function of distance along said first direction.

53. The array of claim 52, wherein said upper surface of said second plate structure includes a set of corrugations to define a slow wave structure.

54. The array of claim 37, wherein an upper surface of said second plate structure is a flat surface.

55. The array of claim 37, wherein an upper surface of the second plate structure has a stepped profile in a first direction parallel to a lower surface of said first plate structure.

* * * * *